US005590871A

United States Patent [19]

Okabe et al.

[11] Patent Number: 5,590,871

[45] Date of Patent: Jan. 7, 1997

[54] RECORDING SHEET FINISHING APPARATUS

[75] Inventors: Hirohiko Okabe, Tokorozawa; Masaaki Sekiguchi, Asaka; Shigemi Yukizane, Chofu; Toshitaka Matsumoto, Asaka; Minoru Kawano, Hachioji, all of Japan

[73] Assignee: Konica Corporation, Japan

[21] Appl. No.: 384,912

[22] Filed: Feb. 7, 1995

[30] Foreign Application Priority Data

Feb. 14, 1994 [JP] Japan ..... 6-017519

[51] Int. Cl.[6] ..... B65H 29/60

[52] U.S. Cl. ..... 270/58.27; 271/221; 399/410; 399/405

[58] Field of Search ..... 355/324, 322; 271/240, 221; 270/58.08, 58.11, 58.12, 58.16, 58.17, 58.27

[56] References Cited

U.S. PATENT DOCUMENTS

| | | | |
|---|---|---|---|
| 5,021,837 | 6/1991 | Uto et al. | 270/58.17 X |
| 5,037,077 | 8/1991 | Kubota et al. | 270/53 |
| 5,092,509 | 3/1992 | Naito et al. | 270/53 X |
| 5,288,062 | 2/1994 | Rizzolo et al. | 270/58.12 |
| 5,382,016 | 1/1995 | Kobayashi et al. | 271/293 |
| 5,449,157 | 9/1995 | Kawano et al. | 270/53 |

*Primary Examiner*—John E. Ryznic
*Attorney, Agent, or Firm*—Jordan B. Bierman; Bierman and Muserlian

[57] ABSTRACT

A recording sheet finisher in use with an image forming apparatus such as a copier. The recording sheet finisher includes a stacker for stacking recording sheets, an aligning member for aligning the bundle of the recording sheets on the stacker, a counter for counting a number of the recording sheets bundled on the stacker, and a controller for controlling the aligning member so that the aligning member aligns the bundle of recording sheets after a first predetermined time period after the last one of the recording sheets is conveyed onto the other ones when the number of recording sheets bundled on the stacker is 25 or more, and aligns the bundle after a second predetermined time period when the number is not less than 25.

3 Claims, 19 Drawing Sheets

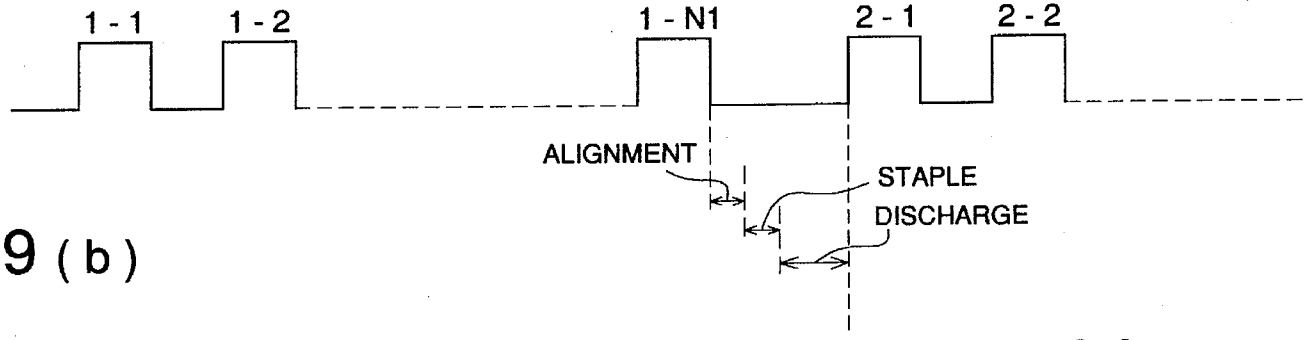
FIG. 19 ( a )
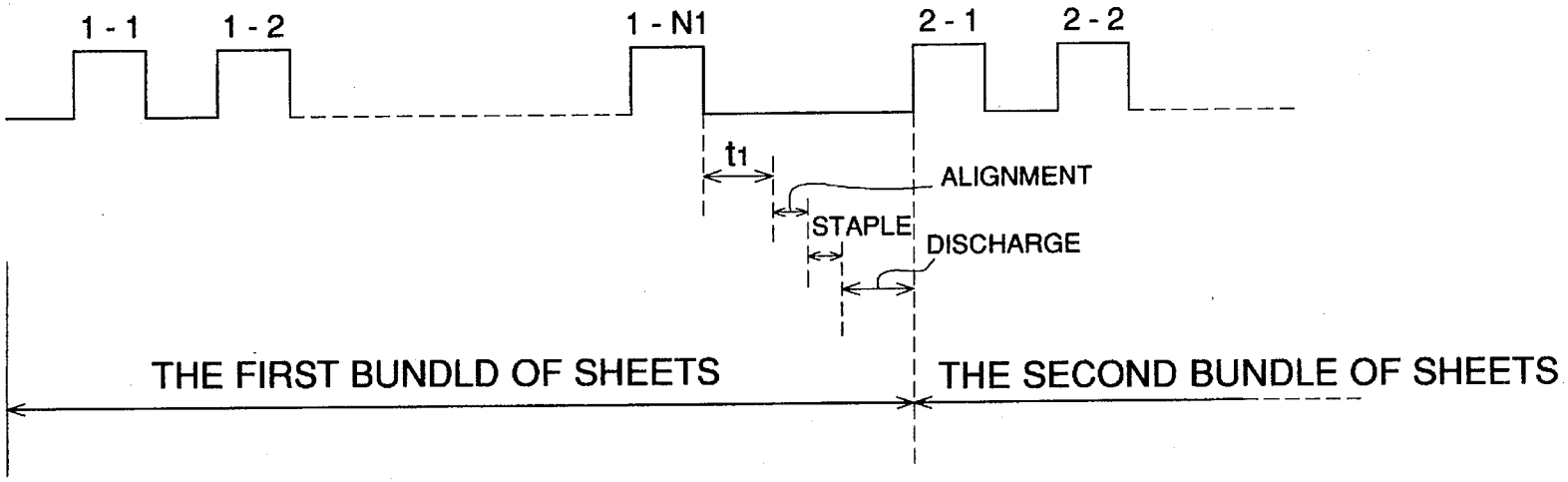
FIG. 19 ( b )

RECORDING SHEET FINISHING APPARATUS

BACKGROUND OF THE INVENTION

The present invention relates to a recording sheet finishing apparatus for automatically conducting the stapling operation by a stapler on recording sheets, on which images are recorded by an image forming apparatus, and after stapling, the recording sheets are delivered from the finishing apparatus. Specifically, the present invention relates to a recording sheet finishing apparatus appropriate for an image forming apparatus in which high speed processing can be conducted.

A recording sheet finishing apparatus, which is called a finisher, is used as an apparatus by which a plurality of recording sheets, on which images have been recorded and which are delivered from the image forming apparatus, are collated and stapled for each copied volume.

This finisher is connected with the image forming apparatus main body in terms of function, and is driven in correspondence with sequential operations of the copying processes.

Accordingly, with respect to the image forming apparatus which can conduct the copying processes at high speed, a finisher, which can perform its function at the correspondingly high speed of the image forming apparatus, is necessary.

Concerning the finisher which can carry out the copying processes at a high speed, various proposals have been made in the following publications: Japanese Patent Publication Open to Public Inspection No. 142359/1985, No. 158463/1985, No. 239169/1987, No. 288002/1987, No. 267667/1988, and No. 276691/1990; and Japanese Patent Publication No. 41991/1993. In these proposals, since only one stapler is provided or only one delivery tray is provided in the finisher, the processing speed can not be greatly increased. Specifically, in the first two publications, since a function in which a bundle of recording sheets stacked on two intermediate trays being collated, are conveyed to one stapler placed at another position, is necessary, the structure becomes complicated, and additional operations are required, which is disadvantageous.

When a bundle of recording sheets, stacked and aligned on the stacker so that one end of the recording sheets are aligned with one end of the stacker which is used as the reference for aligning the recording sheets, are conveyed by a delivery belt, positions of the center of gravity of bundles of recording sheets are different from each other due to sizes of the recording sheets. Accordingly, when the delivery belt does not include the position of the center of gravity of the bundle of recording sheets, the bundle of sheets is inclined and conveyed, resulting in sheet delivery errors. When the delivery belt is composed of one broad belt, the conveyance mechanism is complicated, belt driving loads are increased, or the manufacturing cost is increased, and these become serious problems in high speed delivery and cost.

Further, when delivery trays such as a non-sort tray or an offset tray on which non-stapled sheets are stacked after delivery and a large number of sheets can be stacked, and at least one delivery tray on which bundles of stapled sheets are stacked, are separately provided, then, the number of delivery trays is increased, and delivery trays and driving mechanisms are further complicated, so that the apparatus becomes larger, which is also disadvantageous.

Further, when a large number of sheets are stapled into a bundle of sheets, a sheet stacked close to the final sheet can not arrive at the stop position of the stacker, so that all the sheets occasionally can not be stapled accurately.

SUMMARY OF THE INVENTION

The present invention has solved and improved on the foregoing disadvantages. The object of the present invention is to provide a finisher which can process the coying sheets at a high speed and can be appropriately sufficient for an image forming apparatus in which about 90 sheets can be copied per minute.

The above-described objective can be accomplished by a recording sheet finishing apparatus comprising: stackers on which various sized sheets conveyed from an image forming apparatus are stacked and temporarily accommodated; an aligning means for aligning the recording sheets in the direction perpendicular to the conveyance direction so that one end of the recording sheets are aligned with one end of the stacker which is used as the reference for aligning the recording sheets; a stapling means for stapling a bundle of recording sheets which are stacked on the stacker and aligned by the aligning means; delivery trays for accommodating bundles of the recording sheets which are stapled by staplers; two parallely arranged delivery belts each of which is provided with a protrusion on the periphery so as to push forward the trailing end of the bundle of recording sheets in the direction of the conveyance in order to deliver the bundle of sheets from the stacker onto the delivery tray. Further, the recording sheet finishing apparatus is characterized in that variously sized stapled sheets can be conveyed by the two delivery belts and the delivery belts are arranged so that the center of gravity of the various sized sheets is positioned between the two delivery belts.

The above-described objective can be accomplished by a recording sheet finishing apparatus comprising: stackers on which various sized sheets conveyed from an image forming apparatus are stacked and temporarily accommodated; a stapling means for stapling the bundle of recording sheets stacked and aligned on the stackers; an upper and a lower delivery trays on which the bundles of sheets are stacked and accommodated and which can be elevated up and down; a delivery means for conveying unstapled sheets and directly deliver the sheets onto the upper delivery tray; a collision prevention sensor for detecting a predetermined lowering position of the upper delivery tray; and a lower limit sensor for detecting a predetermined lowering position of the lower delivery tray, and the recording sheet finishing apparatus is characterized in that the lower delivery tray is withdrawn downward when the upper delivery tray is gradually lowered corresponding to the number of accommodated sheets and the collision prevention sensor outputs the detection signal, in a mode in which a large number of unstapled sheets are stacked and accommodated on the upper delivery tray.

Further, the above-described objective can be accomplished by a recording sheet finishing apparatus comprising: stackers on which various sized sheets conveyed from an image forming apparatus are stacked and temporarily accommodated; a movable aligning means for aligning the recording sheets in the direction perpendicular to the conveyance direction; a stapling means for stapling a bundle of recording sheets which are stacked on the stacker and aligned by the aligning means; and a comparing means for comparing the number of sheets stacked on the stacker with a predetermined number of sheets. Further, the recording sheet finishing apparatus is characterized in that the sheets are aligned by the aligning means after a predetermined time has passed after the final sheet is placed on the stacker when it is judged that the number of sheets stacked on the stacker is greater than the predetermined number of sheets.

DETAILED DESCRIPTION OF THE INVENTION

Referring to the attached drawings, an example of a recording sheet finishing apparatus of the present invention will be described as follows.

Figure 1:
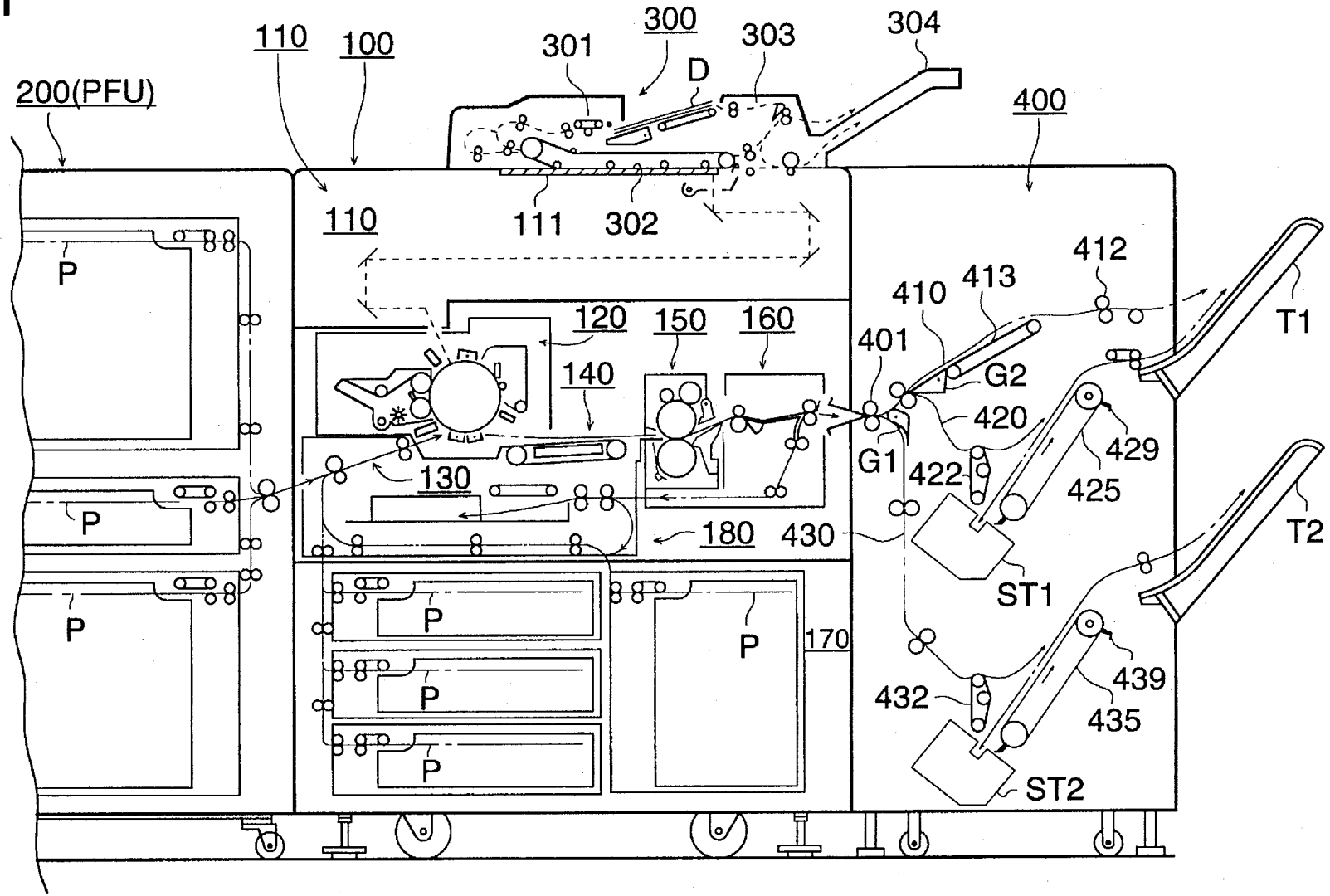
FIG. 1 is a view showing the overall structure of a copier provided with the recording sheet finishing apparatus according to the present invention.

FIG. 1 is a view showing the overall structure of a copier provided with a recording sheet finishing apparatus. Numeral 100 is a copier main body, numeral 200 is a sheet feed unit (PFU unit), numeral 300 is a circulation type automatic document conveyance apparatus (RDH apparatus), and numeral 400 is a recording sheet finishing apparatus [a finisher, (a delivery tray with a stapler apparatus), called an FNS apparatus hereinafter].

The copier main body 100 comprises a scanning exposure section 110, an image forming section 120, a sheet feed section 130, a conveyance section 140, a fixing section 150, a delivery sheet switching section 160, a plurality of sheet feed cassettes 170 and an automatic duplex unit (ADU device) 180.

In the drawing, a one-dotted chain line shows a conveyance path of a recording sheet P. After an image has been formed by an image forming section 120 on the recording sheet P, which is accommodated in a sheet feed cassette 170 located in a lower portion of the copier main body 100 or accommodated in the sheet feed unit (PFU) 200, the recording sheet P is accommodated in the FNS apparatus 400 after passing through the conveyance section 140, the fixing section 150, and the delivery sheet switching section 160; and the above route is referred to as a main route. The recording sheet P branching from the delivery sheet switching section 160 is temporarily stacked in the ADU unit 180, and after that, the recording sheet P is fed again to the sheet feed section 130 in the copier main body 100, and the above route is referred to as a circulation route.

Sheet feeding of a document D placed on a document stack tray of the RDH apparatus 300 is started when a copy button provided on an operation panel of the copier main body 100 is operated. The document D is conveyed onto a platen glass 111 by a conveyance belt 302 through a sheet feeding section 301, and placed at an exposure position.

The document D is exposure-scanned and read out by the scanning exposure section 110. After the document image has been read, a conveyance belt 302 is rotated again and the document D is conveyed to the lowest portion of the bundle of the documents stacked on the document stack tray through a reversal sheet delivery path 303.

In the foregoing, a circulation sheet feeding operation of the document D is stated. The RHD apparatus 300 is also provided with the function of an automatic document feeder (ADF). In this case, the document D, the image of which has been read, is moved straight, and delivered through the delivery roller onto a delivery tray 304 and stacked thereon.

The image of the document D obtained by exposure scanning is recorded onto the recording sheet P, which is fed from the sheet feed cassette 170 or the PFU apparatus 200, through an image processing process in the copier 100.

The recording sheet P, on which the image has been recorded, is temporally fed to the ADU device 180, and reversed. Then, the recording sheet P is delivered from a delivery sheet switching section 160 while the image surface remains face-down, and fed to the FNS apparatus 400 according to the present invention.

Figure 2:
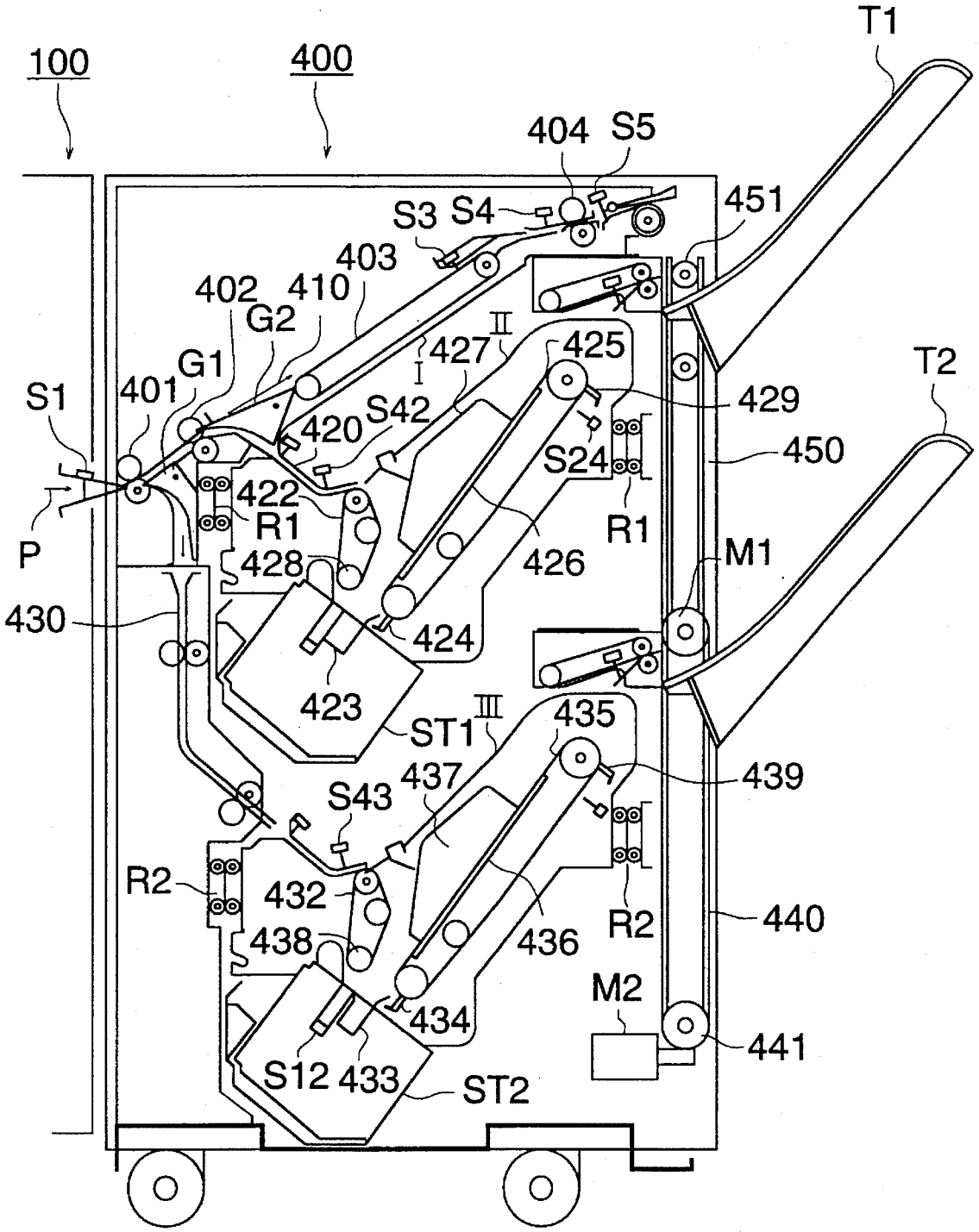
FIG. 2 is a sectional view of the recording sheet finishing apparatus.

FIG. 2 is a sectional view showing the structure of the FNS apparatus 400. The FNS apparatus is provided under the condition that the position and height of the apparatus are adjusted so that the position and height of the receiving roller 401 of the recording sheet P match with those of the delivery port of the copier main body 100, and is connected to a control system to be driven corresponding to the operation of the copier main body 100.

The conveyance path of the recording sheet P, which is connected to the back of the receiving roller 401, branches to a conveyance path 410 for an offset type sheet delivery (the first conveyance path), which is arranged at an upper position of the copier main body 100, and also branches to the second conveyance paths 420 arranged at a middle position and the third conveyance path 430 arranged at a lower position. The recording sheet P is fed onto one of these conveyance paths when angles of switching gates G1 or G2 are selected. I is a first unit which composes the first conveyance path, II is a second unit which composes the second conveyance path, and III is a third unit which composes a third conveyance path.

The second and third conveyance paths 420 and 430 are provided with guide belts 422, 432, and the trailing end of the sheet P is fed to a stapler section. Delivery belts 425 and 435, on which delivery claws 424 and 434 are protrudingly provided respectively, are mounted at positions facing guide belts 422 and 432. The first and second stackers 426 and 436 are respectively provided at positions interposing these delivery belts 425 and 435, forming predetermined inclination angles. Two rollers, each arranged at the lowest portion in sets of three rollers, around which each of guide belts 422 and 432 are wound, may respectively be formed into vane wheels 428 and 438 so that the sheet P more securely comes into contact with stoppers 423 and 433 by the sliding contact operation of the vane wheels 428 and 438 when the sheet P is switched back.

Further, the first stapler ST1 is located opposite to a lower end portion of the first stacker 426, and the second stapler ST2 is located opposite to a lower end portion of the second stacker 436.

A couple of supporting members 450, which are engaged with a plurality of guide rollers 451 and vertically moved, are provided on the right side portion of the FNS apparatus 400. The first delivery tray T1 and the second delivery tray T2 are respectively provided between a couple of supporting members 450, and are moved vertically independent of each other.

The couple of supporting members 450 are fixed to elevation wires 440 which are stretched between exclusive function motors M1, M2 and a pulley 441. When motors M1 and M2 are rotated, the first delivery tray T1 and the second delivery tray T2 are moved vertically independent of each other.

Figure 3:
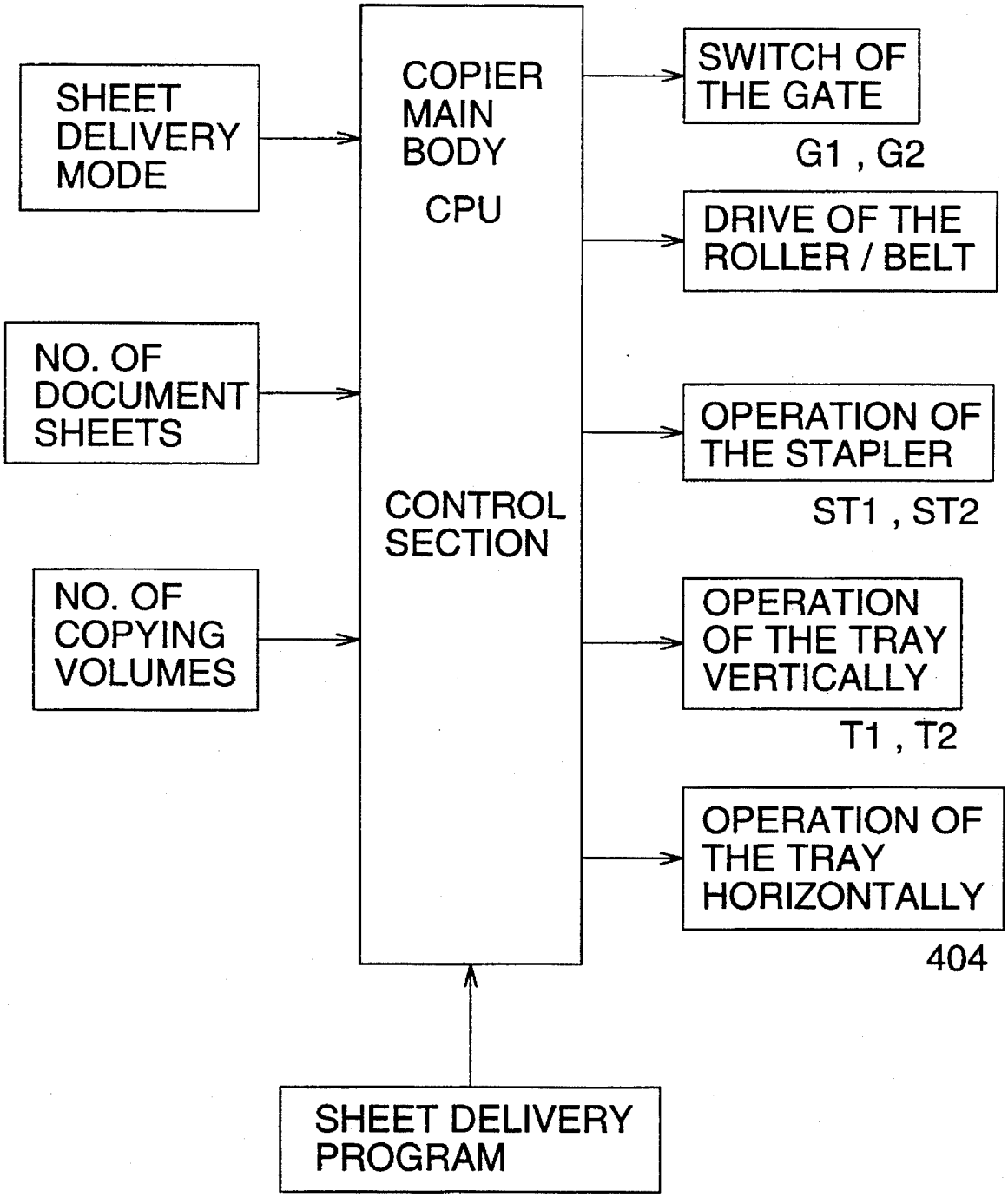
FIG. 3 is a block diagram showing the basic concept of a control system.

A control circuit accommodated in the copier main body 100 comprises basic circuits as shown in FIG. 3. Before the copying operation is started, a sheet delivery mode is selected, and the number of documents and the number of copy volumes are set.

Figure 4:
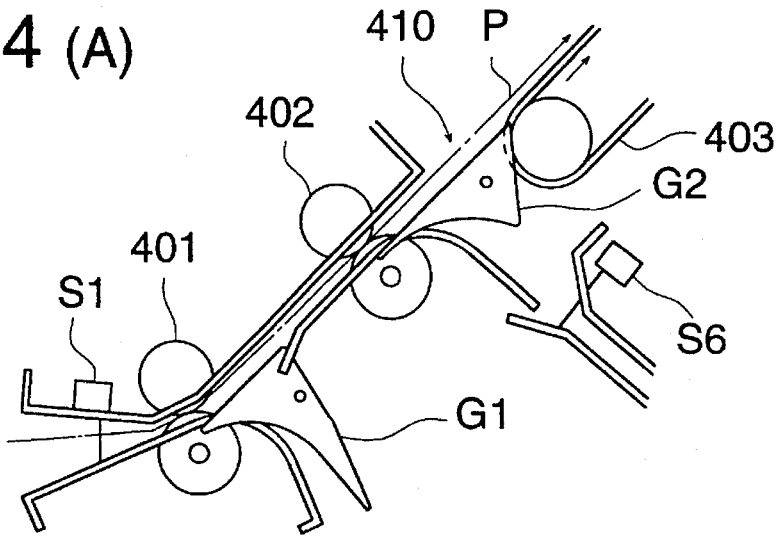
FIG. 4(A), FIG. 4(B) and FIG. 4(C) are sectional views of a switching portion showing a sheet conveyance path in each of the sheet delivery modes.
Figure 4:
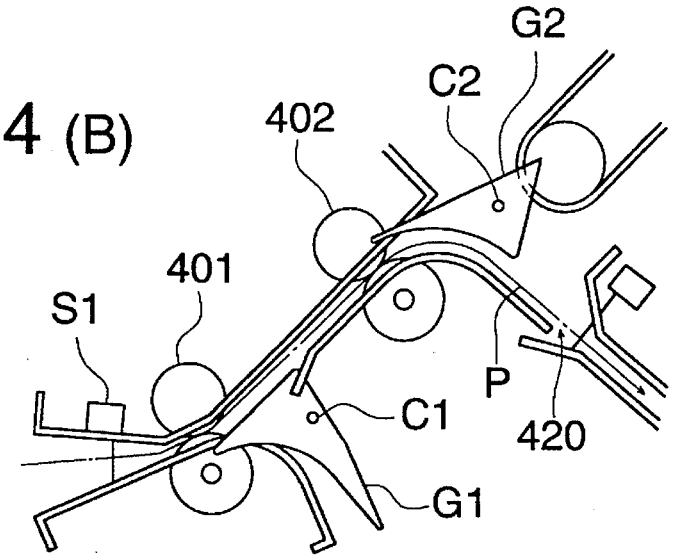
Figure 4:
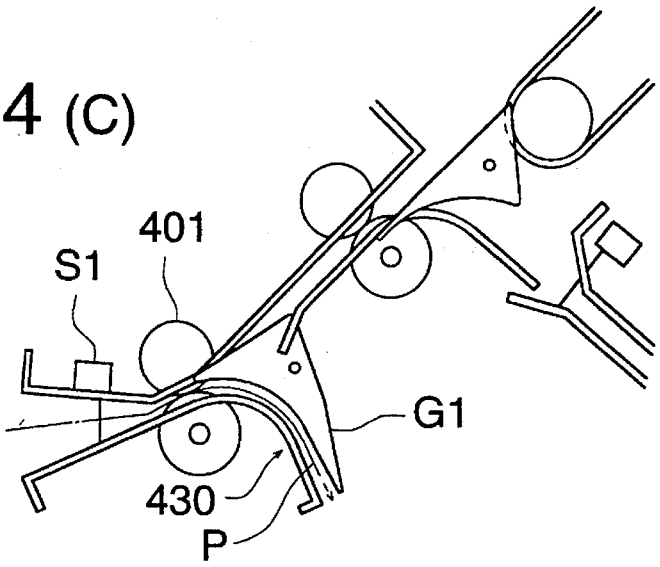

FIG. 4 is a sectional view of the switching section showing the conveyance paths of the sheet P in respective sheet delivery modes.

When the delivery mode is set to the mode in which no stapling operation is required, the switching gates G1 and G2 are maintained at an initial condition. The sheet P is moved straight and delivered outside the apparatus through the first conveyance path (the offset conveyance path) composed of the receiving roller 401, the intermediate roller 402, the conveyance belt 403, and the conveyance roller 404. Then the sheets P are stacked on the first delivery tray T1, which is arranged at the upper position, and the sheets P are accommodated on the delivery tray T1.

This non-staple mode includes actually a non-sort mode and an offset mode, and either of these modes can be selected by the operator. In the non-sort mode, sheets P are, simply, successively stacked on the first tray T1. In the offset mode, sheets P copied from the same document are regarded as one unit, and are slightly shifted perpendicularly to the sheet delivery direction. In this way, sheets P are stacked on another sheet in each unit. That is, in the offset mode, in the case where 10 sheets are sequentially copied for each of a plurality of documents, the first 10 sheets P, which are copies of the first document, are delivered onto the first delivery tray T1 in such a manner that they are superimposed on each other in the same manner as usual. The next 10 sheets P, which are copies of the next document, are stacked in the position which is shifted slightly from the first 10 sheets on the first delivery tray T1. As described above, sheets P, stacked on the tray T1 in the offset mode, are stacked collectively on the tray T1 for each document. Accordingly, sheets P in the offset mode can be more easily discriminated than in the non-sort mode. Although the image forming apparatus of the present invention is not provided with a so-called sorter in which delivery trays are separately provided for each document, sheets P can be discriminated in this offset mode in the same manner as in the sorter.

When the stapling mode is selected as the sheet delivery mode, the switching gate G2 is rotated around a fulcrum C2, and is located forming the angle shown in FIG. 4(B). Accordingly, the recording sheet P fed by a receiving roller 401 is moved straight, and fed to the second conveyance path 420. The recording sheet P then is pushed onto the first stacker 426 through the guide belt 422, and temporarily stacked there. At this time, the back end portion of the recording sheet P is introduced into a stapling section of the first stapler ST1 when the guide belt 422 is rotated.

After the final recording sheet P of the first copy volume, stacked on the first stacker 426, corresponding to the number of documents D, is detected by a sensor $S_1$, the following operations are conducted: the switching gate G1 is rotated around the fulcrum C1 and the angle of the gate G1 is changed to the angle shown in FIG. 4(C); the recording sheets P of the second copy volume are fed downward to the third conveyance path 430; and the recording sheet P is pushed onto the second stacker 436 by a guide belt 432 in the same manner as described above. Then the recording sheets P are stacked on the second stacker 436.

On the other hand, while the recording sheets P of the second copy volume are fed, the recording sheets P of the first copy volume which have been completely stacked, are stapled by the first stapler ST1, then are pushed up resisting the gravity to a predetermined position on the first stacker 426 and placed at the predetermined position on the stacker 426, when transfer levers 475 are returned.

FIGS. 5(A), 5(B) and 5(C) are illustrations showing the sheet delivery section. FIG. 5(A) is a side view, FIG. 5(B) is a plan view, and FIG. 5(C) is a sectional view.

The transfer levers 475 are reciprocally operated only when the bundle of the stapled recording sheets are delivered.

The first delivery belts 425 are rotated in the arrowed direction, and delivers the recording sheets P of the first volume, which are stapled while a delivery claw 424 pushes up the back end surface of the recording sheets P and stops after one rotation, onto the first delivery tray T1. A couple of the first delivery belts 425 are simultaneously operated by the motor M1 through gears and a transmission shaft 425A.

A stacking operation of the recording sheets P of the second volume is completed during the above operations, and the angle of the switching gate G2 is returned to the angle shown in FIG. 4(B). The stapling operation of the recording sheets P of the second copy volume is conducted by the second stapler ST2, and the recording sheets P of the second copy volume stapled by a projection of a stopper 433 and rotation of the second delivery belt 435 are delivered onto the second delivery tray T2 in the same manner as described above.

As described above, according to the FNS apparatus 400 of the present invention, since a plurality of volumes of the recording sheets P, on which images are recorded, can be collated and stapled in parallel at two locations without time difference, the recording sheets P can be rapidly finish-processed.

The motor M is operated corresponding to an amount of the recording sheets P to be delivered, and the first and second delivery trays T1 and T2 are lowered corresponding to the processed amount of the recording sheets P, so that delivery of the recording sheets P can be conducted.

When the offset mode is selected as the sheet delivery mode, the following operations are conducted. Angles of the switching gates G1 and G2 are respectively set at the angles shown in FIG. 4(*a*); the recording sheet P is upwardly fed onto the first conveyance path 410; and the recording sheet P is delivered onto the first delivery tray T1 through the conveyance belt 403 and the delivery roller 404.

A couple of the delivery rollers 404 composed of a driving roller and a driven roller have an offset driving section which can be reciprocally moved in a direction perpendicular to the drawing. Each volume of the recording sheets P is stacked offset in the lateral direction with respect to the delivery sheet by shift-driving of the couple of the delivery rollers after the back end portion of the recording sheet P to be delivered has passed, and each volume of the recording sheets P can be easily sorted.

When the first and second staplers ST1 and ST2 are respectively provided at the viewer's side in the drawing of the first and second stackers 426 and 436, one portion of the upper left portion of the recording sheets P can be stapled in the case where the recording sheet P is delivered under the condition that the length of the recording sheet P is set along the delivery direction. When another stapler is provided at the far side of the drawing, the recording sheets P can be stapled at two locations simultaneously. Further, when the recording sheet P is delivered under the condition that the width of the recording sheet P is set along the delivery direction, one portion of the upper left portion of the recording sheets P can be stapled.

The position of the delivered recording sheet P on stackers 426 and 436 is regulated by: a reference surface (a rising surface) 426A integrally formed with the stacker 426; and the aligning means 427 composed of a slide member 427C which is moved in parallel by the motor M2 through the engagement of pinion 427A and rack 427B.

The following sometimes occurs: when a large number of recording sheets P are delivered onto the stacker 426 (436) and recording sheets P are conveyed at the high speed, bundles of recording sheets P, gradually stacked on the stacker 426 (436), increase quickly and the height of the bundles of the recording sheet P is greatly increased; the final sheet P can not securely drop along the upper surface of the bundle of the inclined sheets by its own weight; the final sheet P is stopped on the way of dropping and the back end of the sheet P does not come into contact with the stopper 423 (433); and the sheets P can not be accurately stapled.

Figure 5:
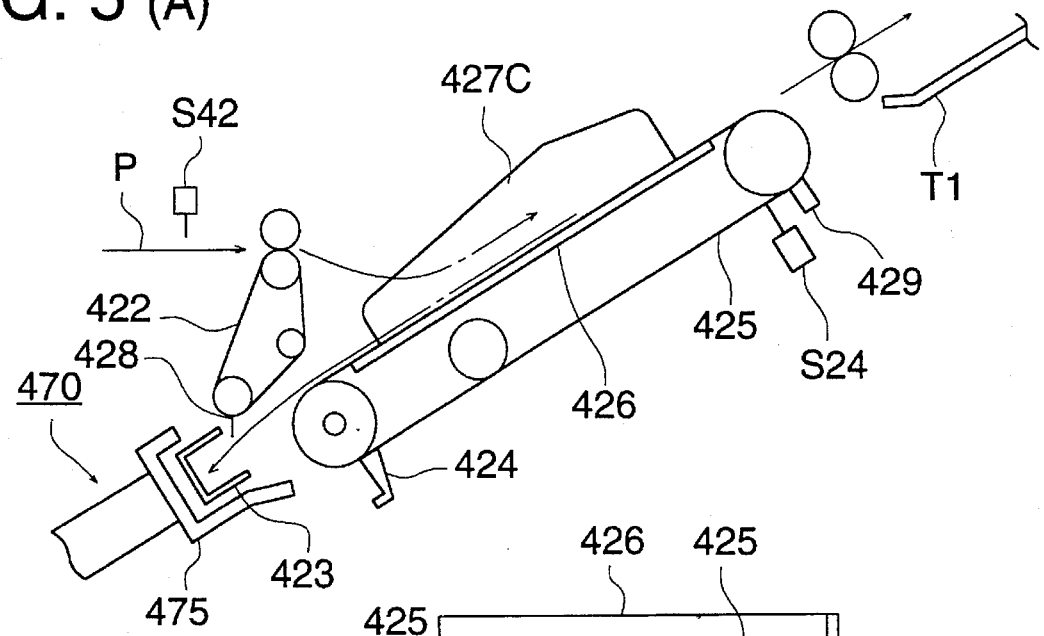
FIG. 5(A), FIG. 5(B), and FIG. 5(C) are illustrations of a recording sheet delivery portion.
Figure 5:
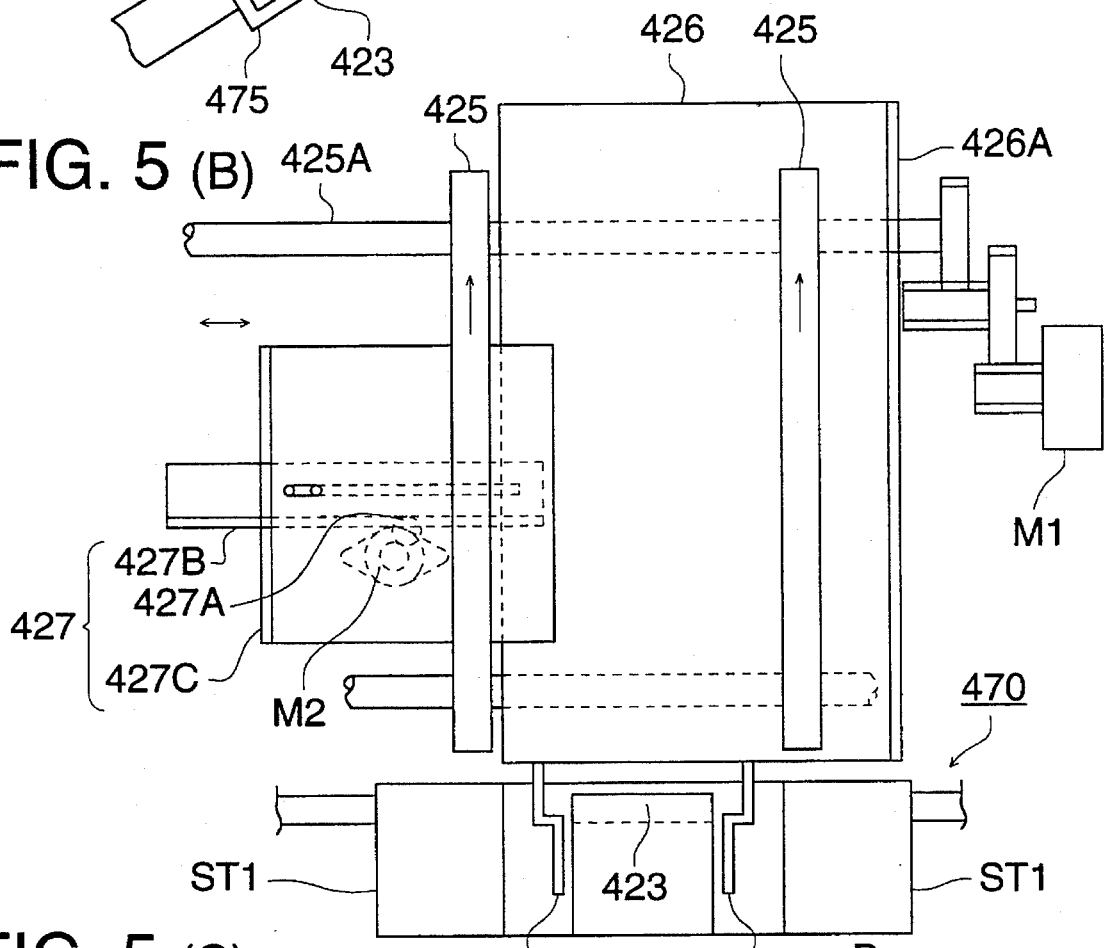
Figure 5:
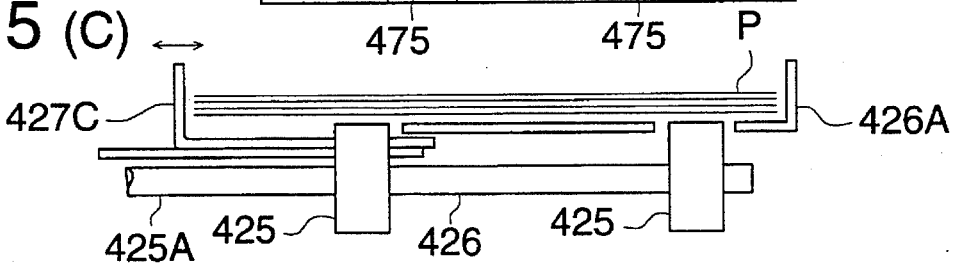

The present invention solves this problem, and even a thick bundle of sheets, the number of which is 25 or more, can be securely aligned and accurately stapled by the present invention. The sheet aligning process of the present invention will be described below as shown in FIG. 5.

① The number of copying volumes and the setting value (N1) of the number of sheets per copying volume are communicated from the copier main body.

② A sensor S42 (S43) provided near the entrance of the stacker 426 (436) of the recording sheet finishing apparatus 400 counts the number of sheets P successively as each sheet P passes the sensor S42 (S43), (N2).

③ The sheet P is conveyed onto the stacker 426 (436), slides down the inclined surface, comes into contact with the stopper 423 (433) and stops.

④ At this stopping position, the slide member (movable aligning plate) 427C of the aligning means 427 is moved from a position, which is separated by about 20 mm from the side end in the direction of width of the sheet P, toward the side end of the sheet P, and presses the sheet P to the reference surface 426A. It is further moved to the position which is about 3 mm inside the side end in the direction of width of the sheet P and is reversed and returned to its original position.

⑤ Every time an individual sheet P is conveyed onto the stacker 426 (436), the movable aligning plate 427C makes one cycle and the sheet aligning motion is carried out as described above. In the case where the sheets P stacked on the stacker 426 (436) are allowed to slide down, the preceding sheet P slides down against the stopper side 423 (433) by its own weight and sliding-contact with the subsequent sheet P when the subsequent sheet P slides down.

⑥ The number of sheets P conveyed onto the stacker 426 (436) is counted by the sensor S42 (S43). When it is detected that the counted number of sheets P coincides with the setting number (N2=N1), the following operations are carried out: the movable aligning plate 427C has made one cycle by the above-described aligning motion with respect to the bundle of sheets on which the final sheet P is superimposed, and after that, the movable aligning plate 427C is moved to the side of the bundle of sheets and presses the sides of the bundle of sheets (the final aligning motion).

⑦ In the bundle of sheet pressing condition, a sheet pressing lever, which will be described later, rises, presses the back end of the bundle of sheets, and the stapling operation is carried out.

⑧ When the number of sheets N2 is not larger than 24, the above-described single sheet aligning motion and the final aligning motion after the stop of the final sheet are carried out.

⑨ When the number of sheets N2 is not less than 25, the above-described one sheet aligning motion is carried out. After the final sheet P is placed on the bundle of sheets on the stacker 426 (436), the final aligning motion is carried out after 1 second has passed. The rising motion of the sheet pressing lever 476 and the stapling motion are carried out while the sides of the bundle of sheets are being pressed. When the large number of sheets of not less than 25 are stacked on the stacker 426 (436), the final sheet may stop without coming into contact with the stopper. In contrast to the above-operation, when a period of time of about 1 second is set as a time margin so that the final aligning motion is carried out, after the sheet aligning operation has been carried out, then, the final sheet P slides down by its own weight on the preceding sheet P, advances to the stopper 423 (433), and stops. As described above, the final sheet P can securely slide down to a predetermined stop position. Specifically, when the sheet P is conveyed at high speeds, this result of sheet aligning is very effective. In this case, the time margin is not limited to about 1 second. The time margin is different depending on the sheet conveyance speed, sheet surface friction, weight of the sheet, the inclination angle of stacker 426 (436), etc., and the optimum time margin is determined according to the settings of the above-described factors.

Staplers ST1, ST2, stackers 426, 436 and delivery belts 425 and 435 are supported by a couple of base plates II and III, and can be attached to and detached from FNS apparatus 400 through a couple of guide rails R1, R2 respectively provided in the FNS apparatus 400. When a door on the viewer's side of the apparatus in the drawing is opened, the foregoing staplers and the like can be detached from the apparatus as a unit, so that maintenance operations such as un-jamming processing can be easily carried out.

Figure 6:
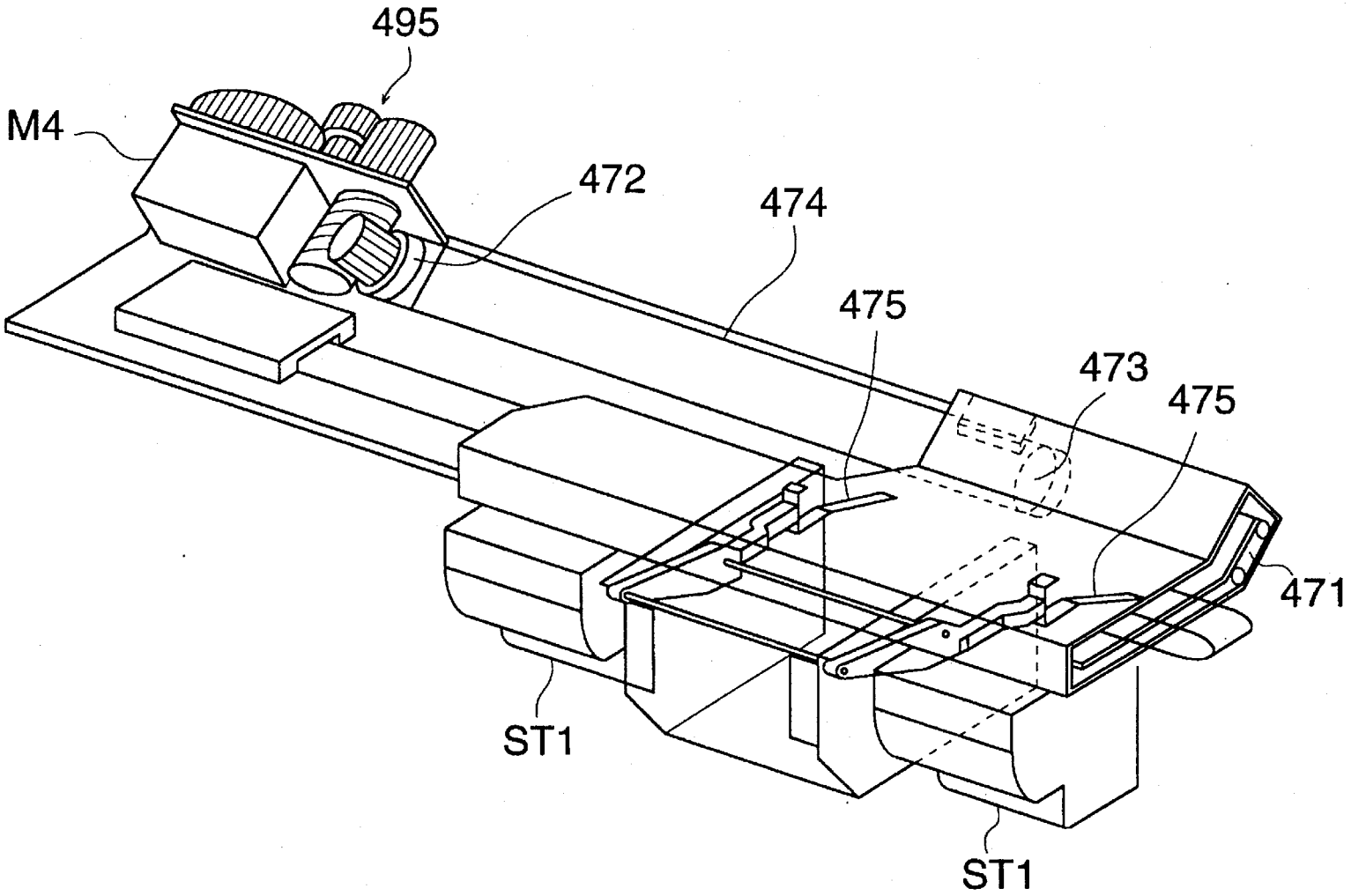
FIG. 6 is a perspective view of the staplers and the recording sheet transfer portion.
Figure 7:
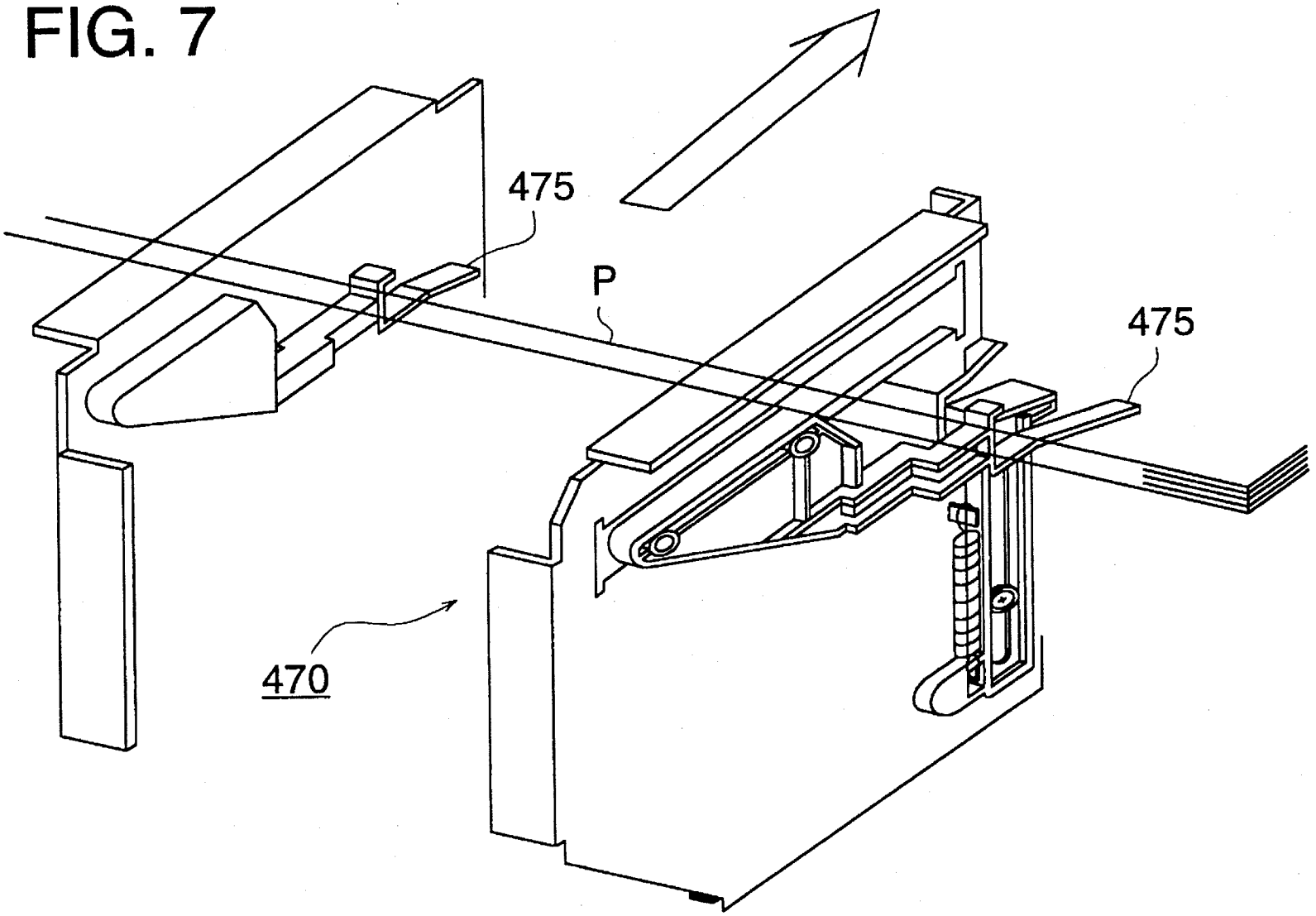
FIG. 7 is a perspective view of the recording sheet transfer portion.
Figure 8:
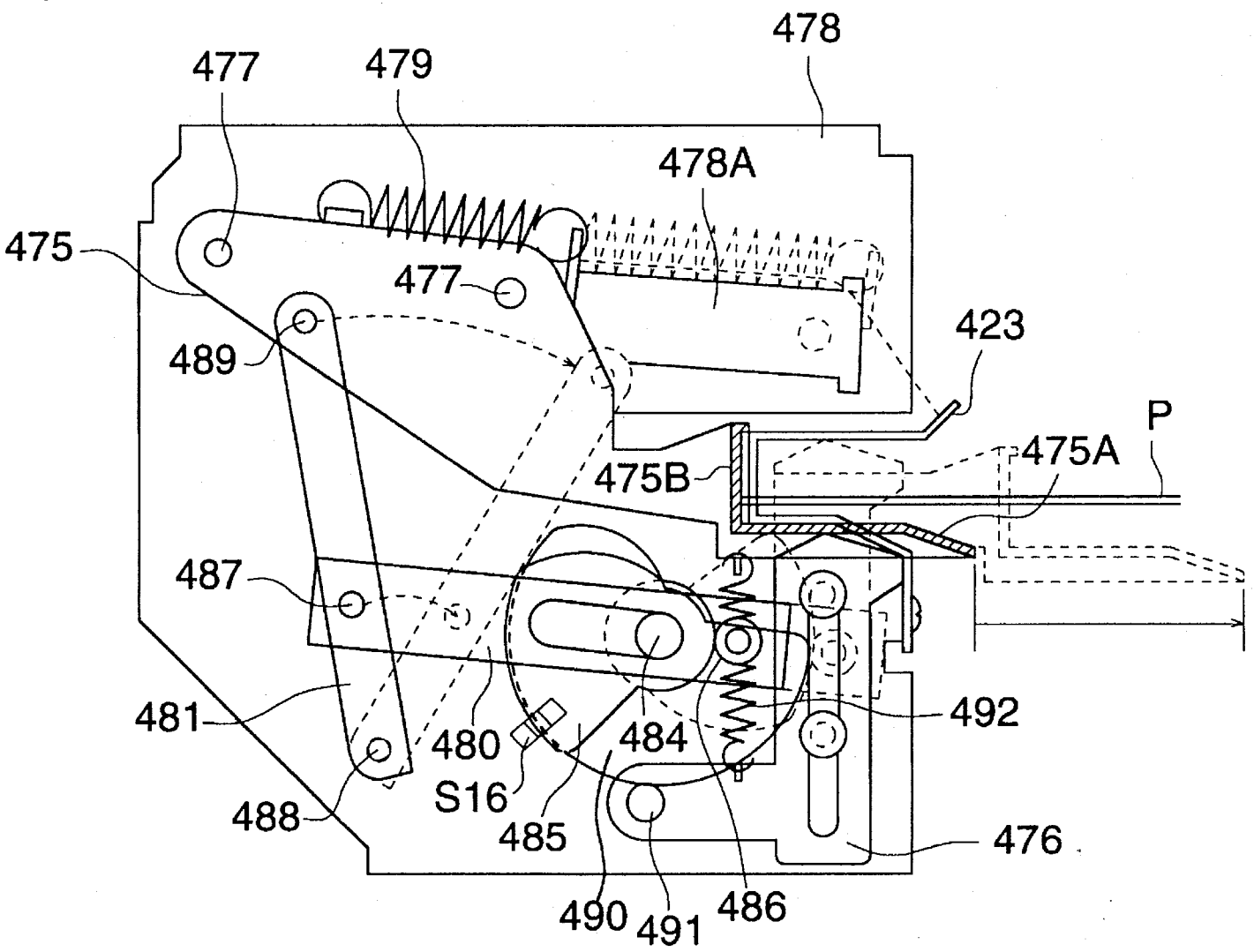
FIG. 8 is a front view of the recording sheet transfer portion.
Figure 9:
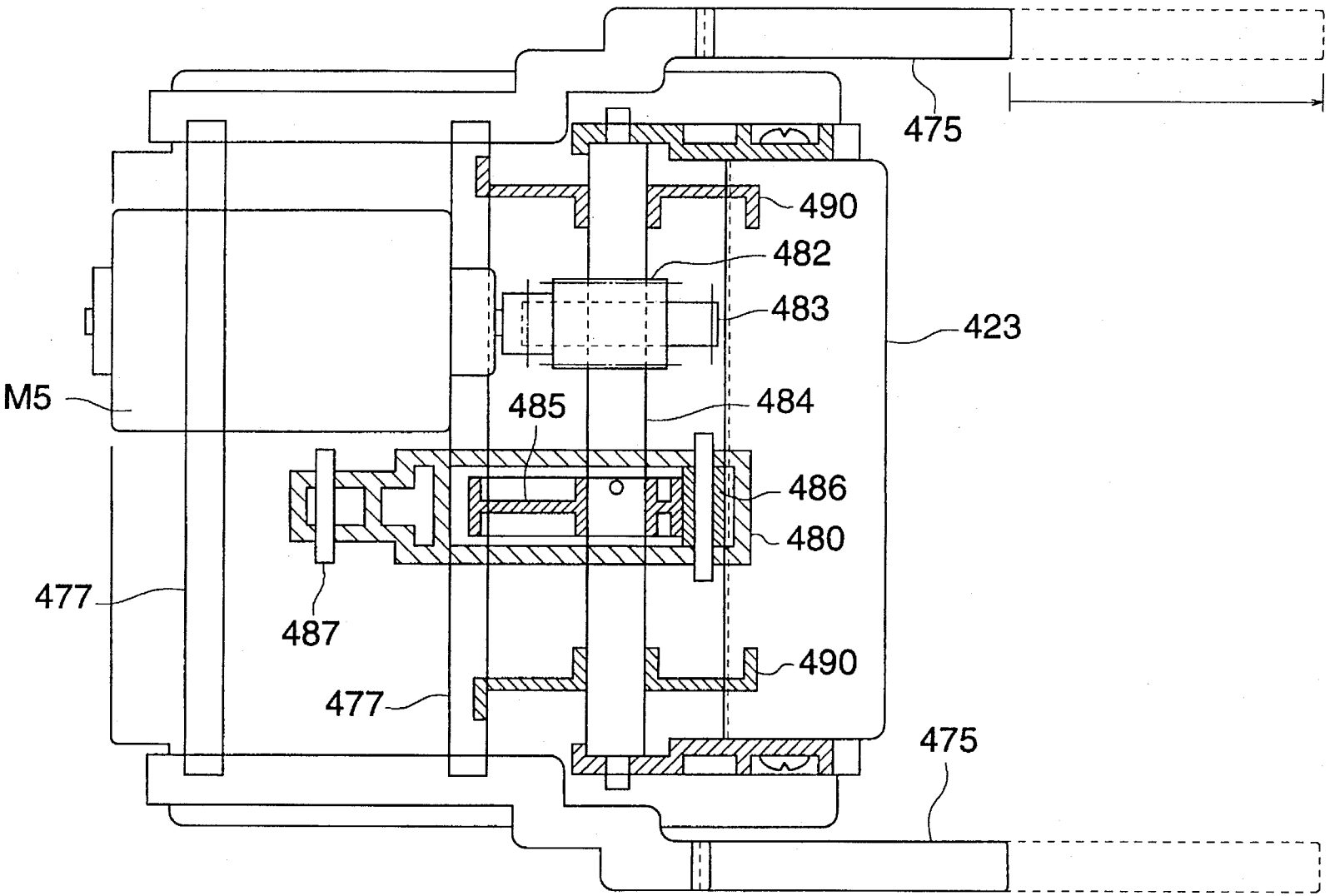
FIG. 9 is a plan view of the recording sheet transfer portion.

FIG. 6 is a perspective view of the stapler ST1 and the recording sheet transfer section. FIG. 7 is a detailed perspective view of the recording sheet transfer section. FIG. 8 is a front view of the recording sheet transfer section, and FIG. 9 is a plan view thereof. In this connection, the transfer section provided at the end of the second conveyance path 420 and stapler ST1, shown in the upper portion in FIG. 2, have the same structure as that of the transfer section provided at the end of the third conveyance path 430 and stapler ST2, shown in a lower portion in FIG. 2, and therefore, their common structures will be described hereinafter.

The transfer section 470 is integrally provided with stapler ST1, and they can slide on a slide rail 471. They are fixed to a portion of a rotatable timing belt 474 stretched between a drive pulley 472 and a driven pulley 473. The drive pulley 472 is connected to a stepping motor M4, which is the drive source, through a gear train 495. The drive and position control of the transfer section 470 and stapler ST1 are carried out by the stepping motor M4.

The transfer section 470 has the following structure in which: the trailing edge of the recording sheet P, which has been introduced from the second conveyance path 420, slides on the conveyance belt 425 and the first stacker 426 being guided by the guide belt 422, moves upward, and moves downward after delivery, is temporarily held and stopped; after the recording sheets P are stapled (stapling processed) at this stop position, the recording sheet P is sent out again, and sent by the delivery claw 424 provided on the delivery belt 425.

The transfer section 470 comprises: a stopper 423 against which the trailing edge of the recording sheet P is pushed for aligning the edge of the recording sheet P, and which is used as a reference for the pushing operation; a couple of transfer levers 475, which are movable and which send the recording sheet P to the delivery belt 425; and a couple of movable pressing levers 476 which press the recording sheets P at the time of stapling.

The transfer lever 475 has a guide surface section 475A for introducing the recording sheet P, and a pushing surface 475B which pushes out the trailing edge of the recording sheet P. A couple of transfer levers 475 are connected by two connection bars 477, and integrally formed with each other. The transfer lever 475 can slide in a guide groove section 478A provided in the frame 478 of the transfer section 470 (indicated by a broken line shown in FIG. 8). The transfer lever 475 is forced by a spring 479 in one direction. The transfer lever 475 is moved through the first link member 480 and the second link member 481 which are driven by a motor M5, which is the driving source. The driving force of the motor M5 is transmitted to a drive shaft 484 for rotating the shaft 484 through a gear train comprising a worm 482 and a worm wheel 483, by which the speed of the motor M5 is reduced. A cam 485 is fixed in the proximity of the central portion of the drive shaft 484. A roller-shaped cam follower 486 is rotatably supported by one end of the first link member 480. When the cam 485 is rotated, the cam follower 486 presses against the cam and follows it, and thereby, the first link member 480 can be moved in the lateral direction shown by a broken line in FIG. 8. The left end of the first link member 480 is rotatably connected to the second link member 481 by a pin 487. The second link member 481 is supported by a fulcrum pin 488 such that the member 481 can be oscillated around a fulcrum pin 488. The other end of the second link member 481 is connected to the transfer lever 475 by a pin 489.

In FIGS. 8 and 9, the solid line shows the initial position of the recording sheet transfer section, and the stopping position thereof at stapling, and the broken line shows the condition that the stapled recording sheets P are sent out to the delivery belt 425 side. When the motor M5 is rotated, the driving shaft 484 is rotated through the worm 482 and worm wheel 483. When the cam 485, integrally formed with the driving shaft 484, is rotated, the cam follower 486 presses against the cam, the first link member 480, integrally formed with the cam follower, is moved to the right. The second link member 481 is oscillated clockwise, in the drawing, around the fulcrum pin 488, and the transfer lever 475 is moved to the right in the drawing. When the transfer lever 475 is moved, the pushing surface 475B of the transfer lever 475 pushes out the trailing edge of the recording sheet P, and sends the recording sheet P to the delivery belt 425 (435) side.

Next, a sheet pressing operation by a sheet pressing lever 476, by which the recording sheets P are pressed before the stapling operation, will be explained.

Two cams 490 are fixed in the proximity of both ends of the driving shaft 484, and press against a cam follower 491 fixed to the lower portion of the sheet pressing lever 476. When the driving shaft 484 is rotated, the cam follower 491, which presses against the cam 490, is moved upward with the sheet pressing lever 476 against the force of the spring 492, and pushes the trailing edge of a bundle of the recording sheets to the upper surface of the inside of the C-shaped stopper 423. In this condition that the recording sheets are pressed together, the stapling operation is conducted by staplers ST1. A sensor 16 is a photo-interrupter type optical sensor to detect the sheet pressing operation by the sheet pressing lever 476, and generates a signal when the optical path is open or closed by an optical path interruption section provided on the cam 490.

Figure 10:
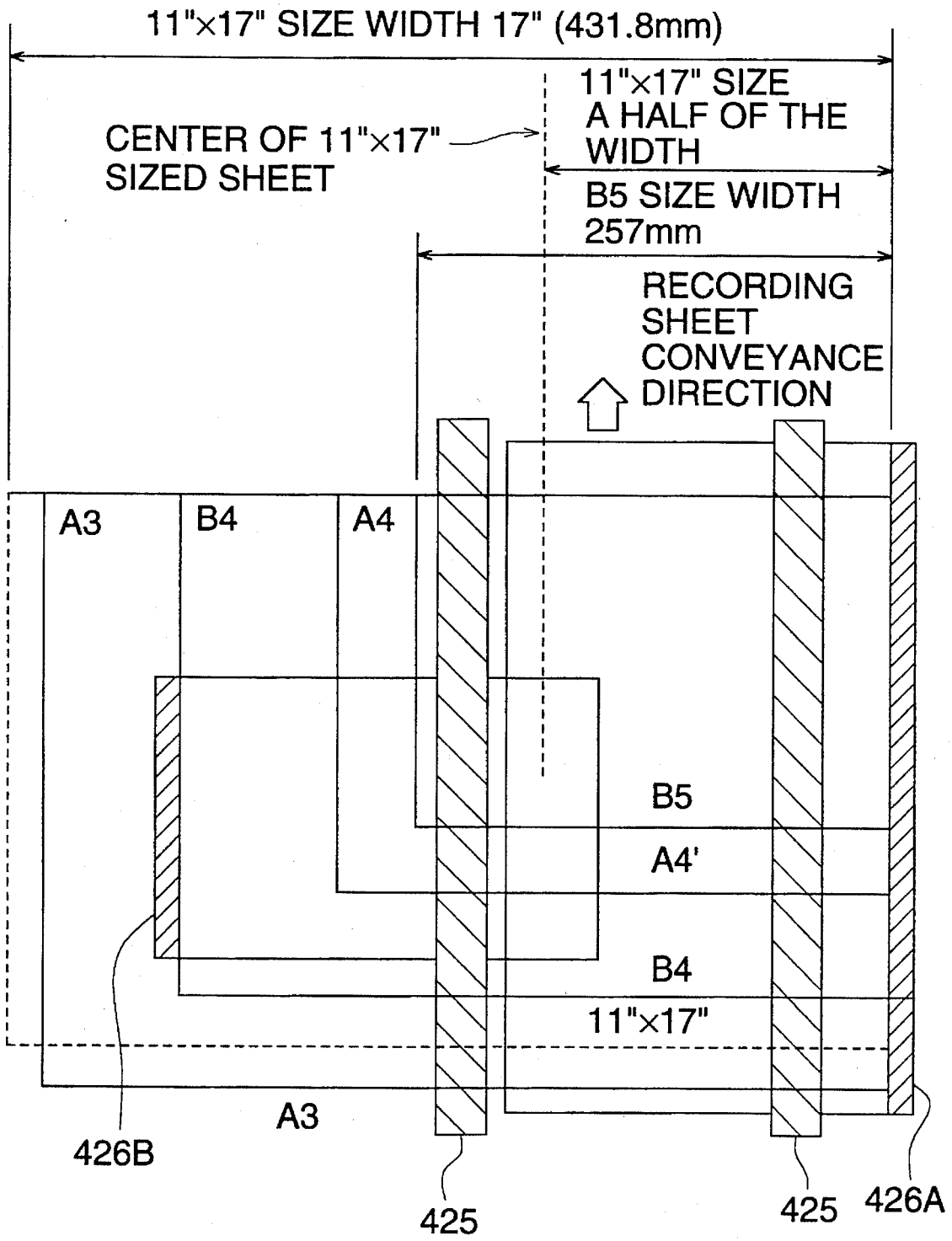
FIG. 10 is a plan view showing circumstances in which recording sheets of various sizes are stacked on a delivery tray in the recording sheet delivery portion.

FIG. 10 is a plan view showing conditions that various sizes of recording sheets P are stacked in the delivery section under the condition that one side of the recording sheets is aligned with a reference line.

When bundles of the recording sheets, one side of which is aligned with the reference line, are conveyed by the delivery claws of two belts 425, the center of gravity of the recording sheets P is different depending on the sizes of the recording sheets. Accordingly, when two delivery belts 425 are located at a position which does not include the center of gravity of the recording sheets, bundles of recording sheets are inclined, so that the recording sheets can not smoothly be conveyed. Further, when only one delivery belt is used, the belt having a large width is necessary, resulting in an increase in the manufacturing cost.

According to the present invention, two delivery belts 425 are rotatably provided, and various sizes of recording sheets can be delivered without being inclined. That is, when one stapling operation is conducted in a front portion or back portion of large sized recording sheets, positions of stapler ST1 and the transfer section are longitudinally deviated, and therefore, the center of gravity of the recording sheets are separated from the transfer lever 475. In this case, after stapling processing, the transfer operation is carried out after the transfer lever 475 has been moved on a sliding rail 471 of the moving means to a position including the center of gravity by the rotation of the timing belt 474.

As described above, since a unit, in which the stapler ST1 and the transfer section are integrally formed with each other, is moved after the stapling operation, a position including the center of gravity of the recording sheets P can be moved, and thereby, the recording sheets are not inclined and the transfer operation can be smoothly carried out. Further, even when there are obstacles, such as the delivery belt 425, in the transfer position of the transfer lever 475, because the recording sheets are transferred onto the delivery belt 425 side after movement of the transfer lever, the stapling operation can be carried out in any position.

Figure 11:
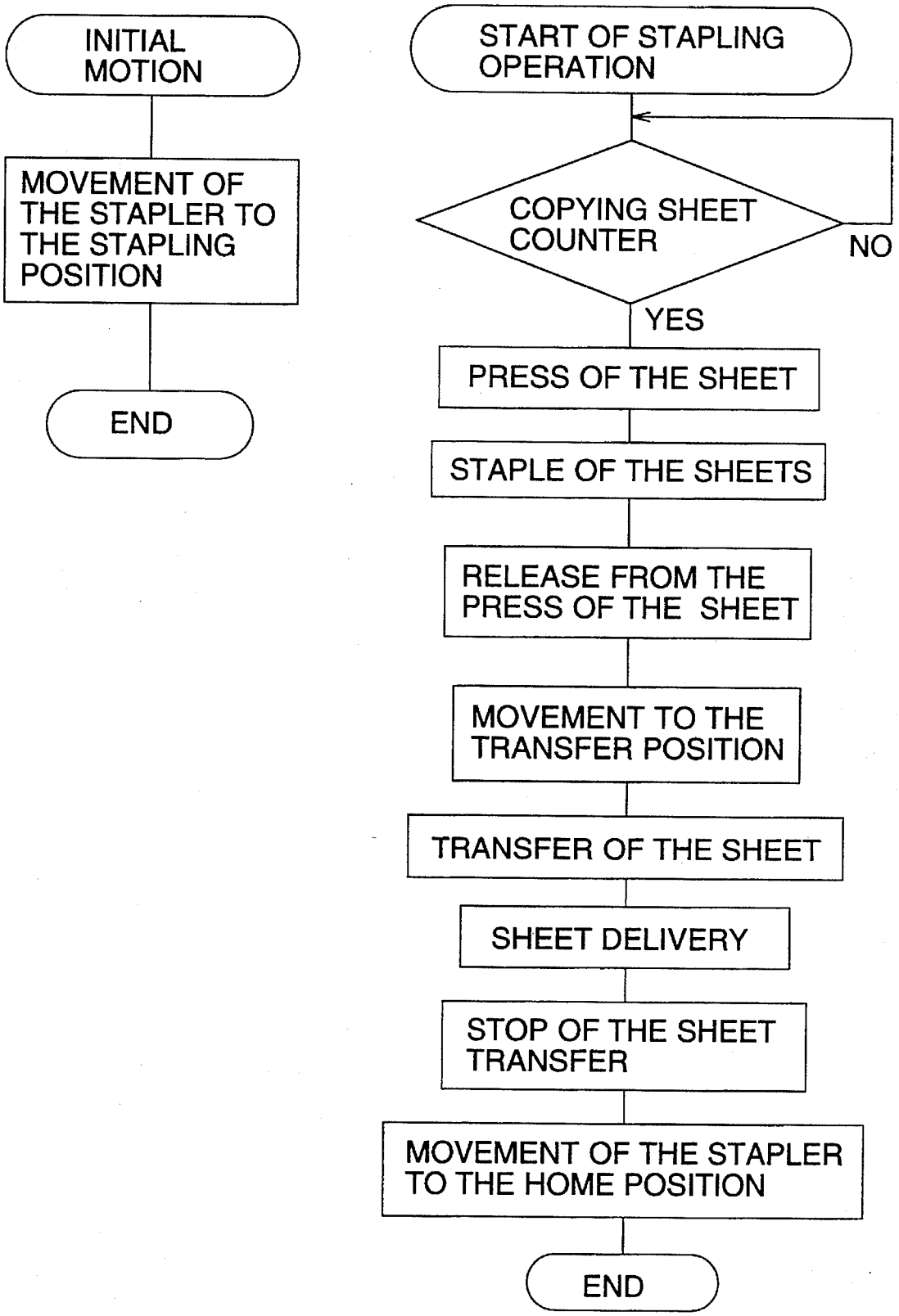
FIG. 11 is a flow chart of the recording sheet finishing process.

FIG. 11 shows a flow chart of the process of the above-described recording sheet finishing operation.

Figure 12:
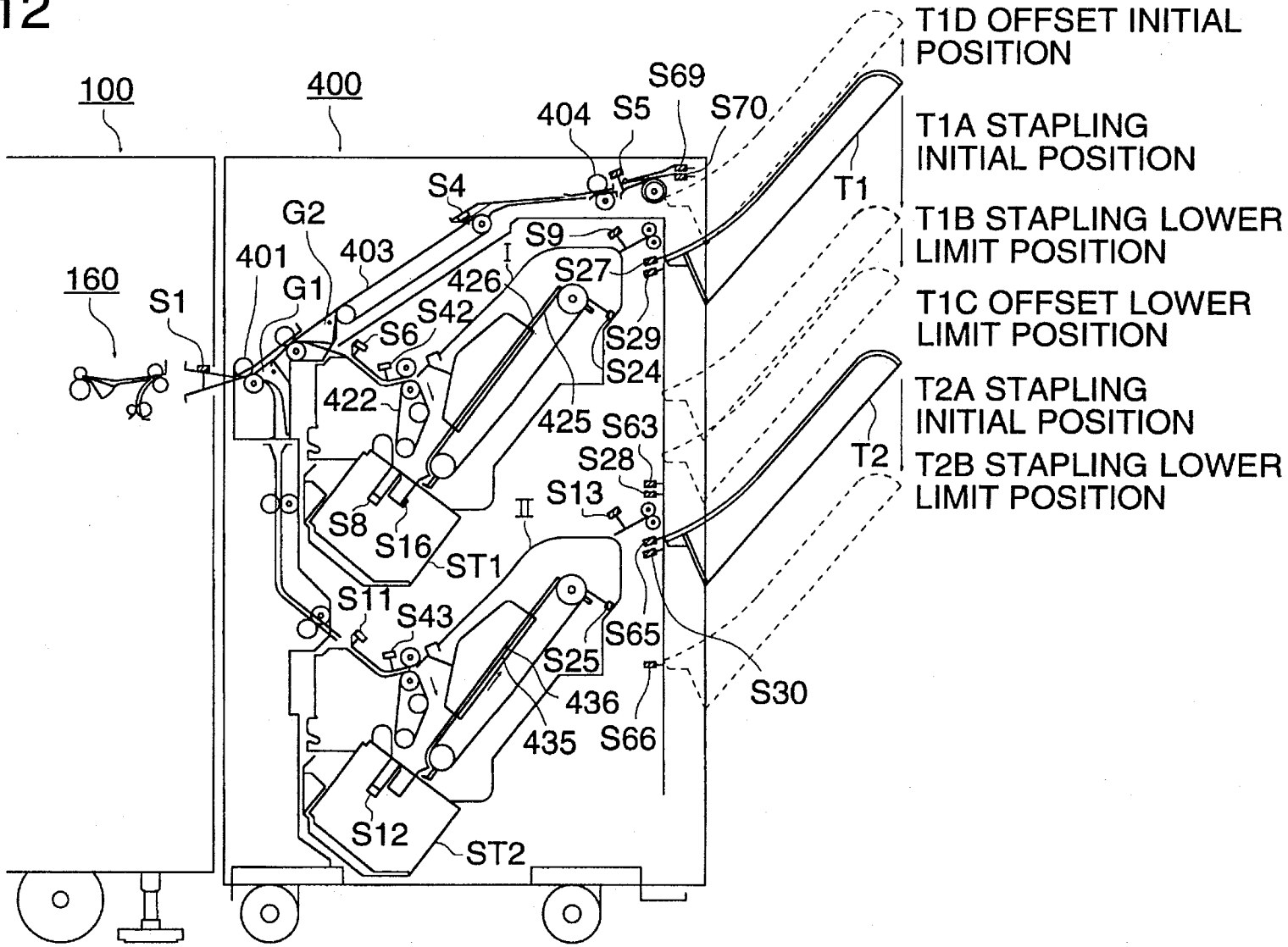
FIG. 12 is a view showing the arrangement of sensors and the movement of delivery trays of the recording sheet finishing apparatus.

FIG. 12 is a view showing sensor positions and movement of the delivery trays in the improved recording sheet finishing processing apparatus 400 according to the present invention.

Initially, a sheet passing sensor S1 is provided in the proximity of the introduction opening for the recording sheets in the FNS apparatus 400, and detects the existence of a recording sheet P in the FNS apparatus 400 when the recording sheet P passes through the sensor position. A sheet trailing end passage sensor S4 is provided on the upstream side of the delivery roller 404 of the offset conveyance path 410, and the delivery roller 404 is shifted in the direction perpendicular to the drawing at the time of the offset mode conveyance when the sensor S4 detects passage of the trailing end. A sheet delivery sensor S5 is provided on the downstream side of the delivery roller 404 located in a portion further downstream, and detects the existence of the recording sheet.

Sheet passage sensors S6 and S42 are provided in the upstream portion of the conveyance roller 421 of the second conveyance path 420 located in the lower portion of the offset conveyance path 410, and detect the passage of the recording sheet P. A sensor S8 detects the existence of the recording sheet P on the first stacker 426 located in the upper portion of the apparatus. S16 detects the pressing position of the recording sheets in the transfer section located in the upper portion. S24 is a home position sensor of the delivery belt 425. S9 is a sheet delivery sensor.

In the same way, sheet passage sensors S11, S43, a sheet existence detection sensor S12, and a sheet delivery sensor S13 are also provided in the third conveyance path 430.

Next, an offset upper portion detection sensor S69, and an offset sheet existence sensor S70 are provided in the proximity of a delivery opening of the offset conveyance path 410 located in the uppermost portion, in an elevation drive section for the delivery trays T1 and T2. A tray upper limit detection sensor S27, a tray sheet removal detection sensor S29, a tray collision detection sensor S63, and a tray lower position detection sensor S28, by which the elevation operation of the first delivery tray T1 is controlled, are provided in the proximity of the delivery opening of the second conveyance path 420 located in the middle portion, and in its lower portion. A tray upper limit position detection sensor S65, and a tray sheet removal detection sensor S30, by which the elevation operation of the second delivery tray T2 is controlled, are provided in the proximity of the delivery opening of the third conveyance path 430 located in the lower portion. A tray lower limit position detection sensor S66, by which the lowering operation of the second delivery tray T2 is controlled, is provided in the lowermost portion.

The elevating operation of sheet delivery trays T1 and T2 is carried out in real time corresponding to the amount of stacked delivered sheets. Sheet delivery trays T1 and T2, moved in advance at predetermined positions, repeat the lowering operation as the stacked amount of sheets on each delivery tray is increased after that. Delivery trays T1 and T2 maintain their predetermined positions while the upper surfaces of the delivery trays are being detected by the respective upper limit sensors S27 and S65.

In FIG. 12, T1A shows the initial position (initial setting position) of the first delivery tray T1 for the stapling operation, and T1B shows the lower limit position thereof for the stapling operation under the condition that a maximum of 1500 recording sheets are stacked on the tray. T1C shows an offset lower limit position of the first delivery tray T1 under the condition that a maximum of 2000 recording sheets are stacked on the tray, and T1D shows the offset initial position thereof.

As a raised or lowered position of the second delivery tray located in the lower portion, T2A shows the initial position at the stapling operation, and T2B shows the lower limit position of the second delivery tray T2 when a maximum of 2000 recording sheets are stacked on the first delivery tray T1. At this lower limit position T2B of the second delivery tray T2, the sheet delivery operation not only from the first stacker 426, but also from the second stacker 436 is prevented.

In the non-staple mode, a maximum of 2000 sheets can be stacked on the first delivery tray. In this case, as described above, sheets are controlled so that they pass through the offset conveyance path 410, and sheet delivery from the second conveyance path 420 and the third conveyance path 430 is prevented. That is, sheets are not delivered onto the second sheet delivery tray.

Figure 15:
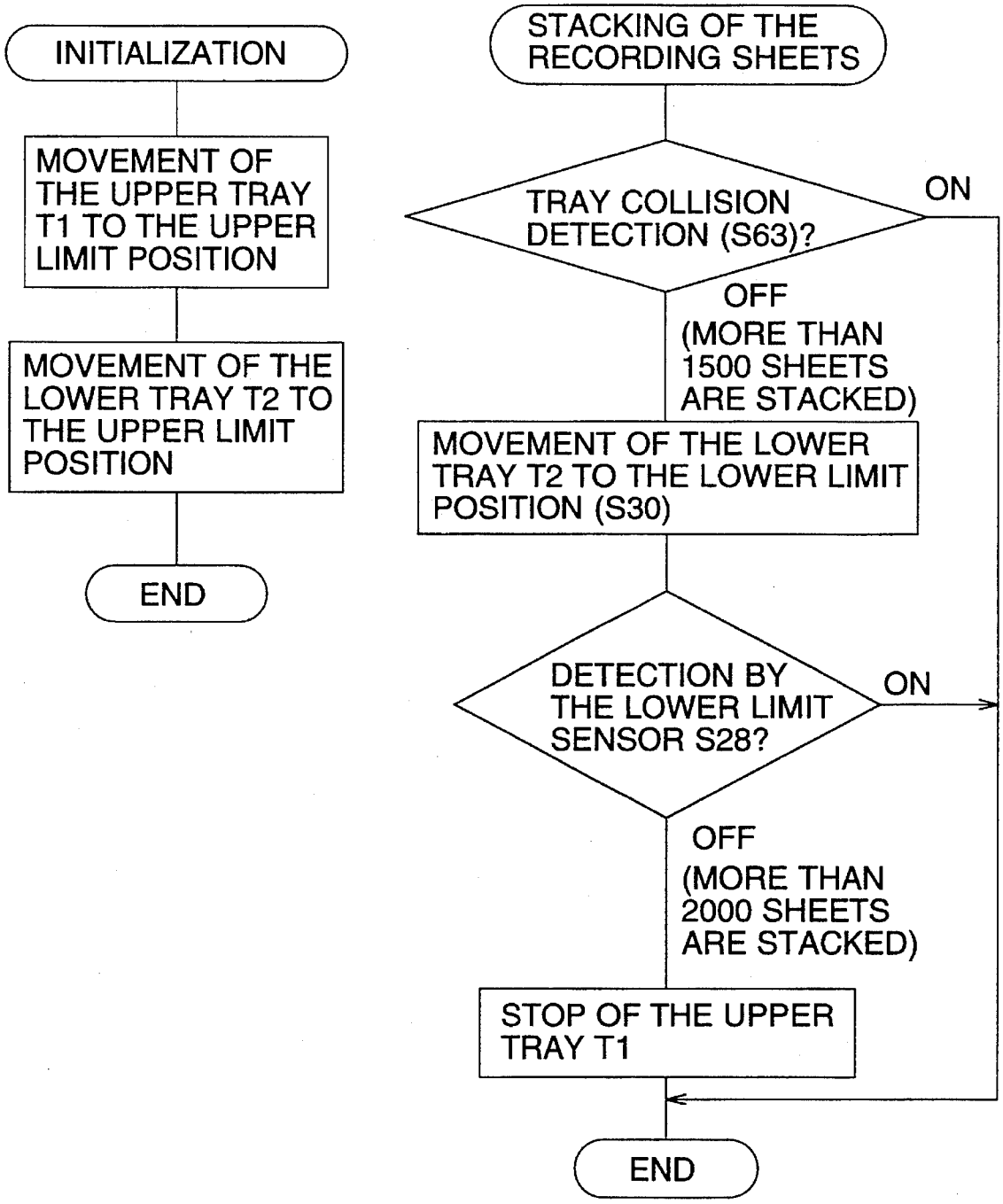
FIG. 15 is a flow chart showing circumstances in which the recording sheets are delivered and stacked on the delivery tray.

FIG. 15 is a flow chart showing the operation of the first delivery tray (the upper tray) T1 and the second delivery tray (the lower tray) T2. In the recording sheet finishing processing apparatus of the present invention, the elevation reference position (initial position) of the delivery trays T1 and T2 are detected by the tray sheet removal detection sensors S29 and S30, and the detection of stacked amounts of the recording sheets on the delivery trays T1 and T2 are conducted by the tray upper limit position detection sensors S27, and S65. Further, the lower limit of the delivery trays T1 and T2 is detected by the tray lower limit position detection sensors S28 and S66. The detected portion of the upper tray T1 is detected by the tray collision detection sensor S63. When the lower tray T2 is regulated as described above, 2000 recording sheets P can be stacked on the upper tray T1.

That is, when the tray collision detection sensor S63 detects lowering of the first sheet delivery tray T1, the detection circuit is deactivated, and it is regarded that the number of sheets on the tray T1 can equal to 1500.

In this case, the second sheet delivery tray T2 is lowered to the position in which the upper surface of the tray T2 is detected by the sheet removal detection sensor S30, without depending whether or not any sheets are stacked on the tray, so that the tray T2 does not collide with the first sheet delivery tray T1. After that, when the lower limit detection sensor S28 detects the first sheet delivery tray T1 and the detection circuit is deactivated, then it is regarded that the number of sheets stacked on the first sheet delivery tray T1 totals 2000, and the lowering of the first sheet delivery tray T1 is stopped. The sheet stacking routine shown in FIG. 15 is repeated until the tray collision sensor S63 and the lower limit detection sensor S28 detect the lowering of the first sheet delivery tray T1.

Figure 13:
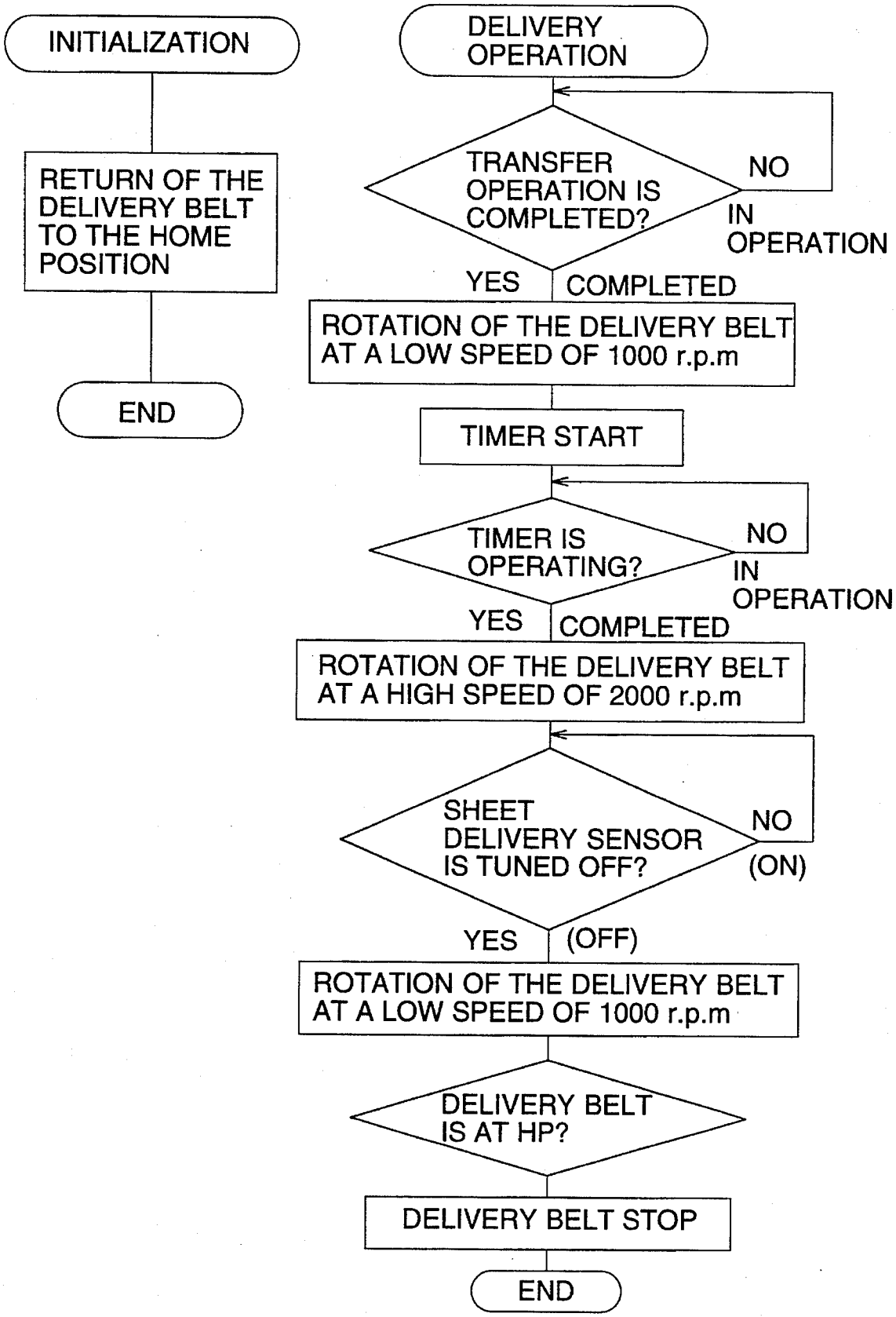
FIG. 13 is a flow chart showing a recording sheet delivering operation.
Figure 14:
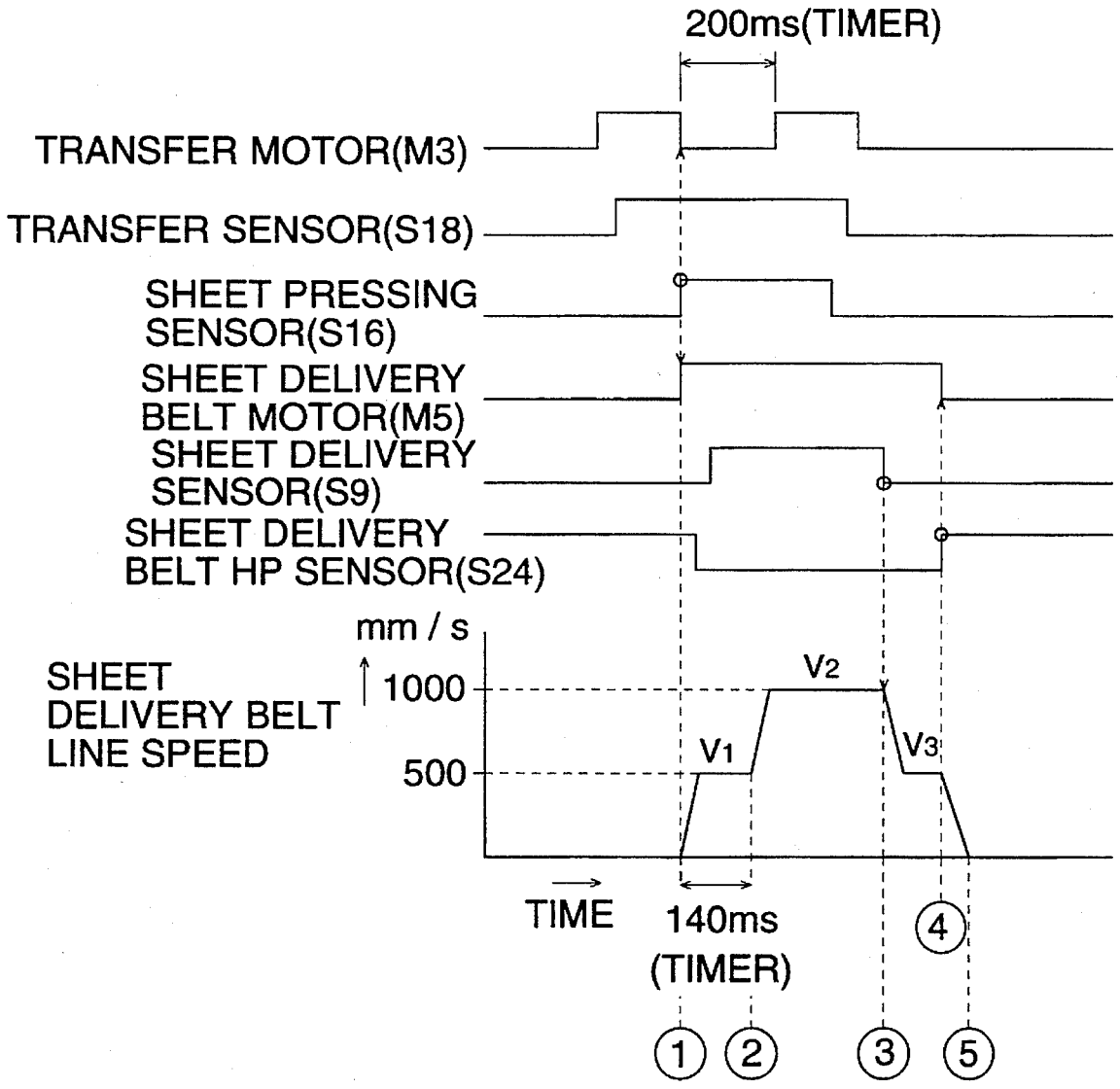
FIG. 14 is a time chart of the recording sheet transfer operation.

FIG. 13 is a flow chart of a recording sheet delivery operation by the recording sheet finishing processing apparatus 400 according to the present invention, and FIG. 14 is a time chart of the above-described operation.

① When the stapled recording sheets P is sent from the transfer section onto the delivery belt 425 (435), the delivery speed $V_1$ of the delivery belt 425 (435) is set at 500 mm/s (1000 r.p.m), which is a relatively low speed, and the belt starts its rotation. While the belt is rotated at this low speed, the delivery claw 424 (434) provided on the delivery belt 425 (435) presses the trailing edge of the recording sheet P and sends out the recording sheet P.

② A timer is started from the time when the delivery belt 425 (435) starts its rotation. After a period of time of 140 ms have passed, the delivery speed $V_2$ of the delivery belt 425 (435) is switched to 1000 mm/s (2000 r.p.m), which is a relatively high speed, and the recording sheet P is conveyed at the high speed.

③ When a recording sheet P is separated from the delivery belt 425 (435), the sheet delivery sensor S9 (S13) is turned off, and the delivery speed $V_3$ of the delivery belt 425 (435) is decreased to 500 mm/s (1000 r.p.m), which is a low speed. When a portion 429 (439) of the delivery belt 425 (435) to be detected passes through the photo-interrupter optical path of the home position sensor S24 (S25) at low speed, the detection accuracy is increased.

④ When the delivery belt 425 (435) is rotated at a low speed, and the home position sensor S24 (S25) is turned on, the sensor sends a signal to stop the drive of the delivery belt 425 (435).

⑤ The. delivery belt 425 (435) stops.

When the conveyance speed of the delivery belt 425 (435) is adjustably controlled as described above, the folding of recording sheets after the stapling operation, is eliminated at low speed conveyance; the delivery belt 425 (435) is precisely stopped at the home position; and when the recording sheets are conveyed at high speed in the middle portion of the conveyance path, the period of time for finishing processing is reduced, and the copy productivity can be increased.

Figure 16:
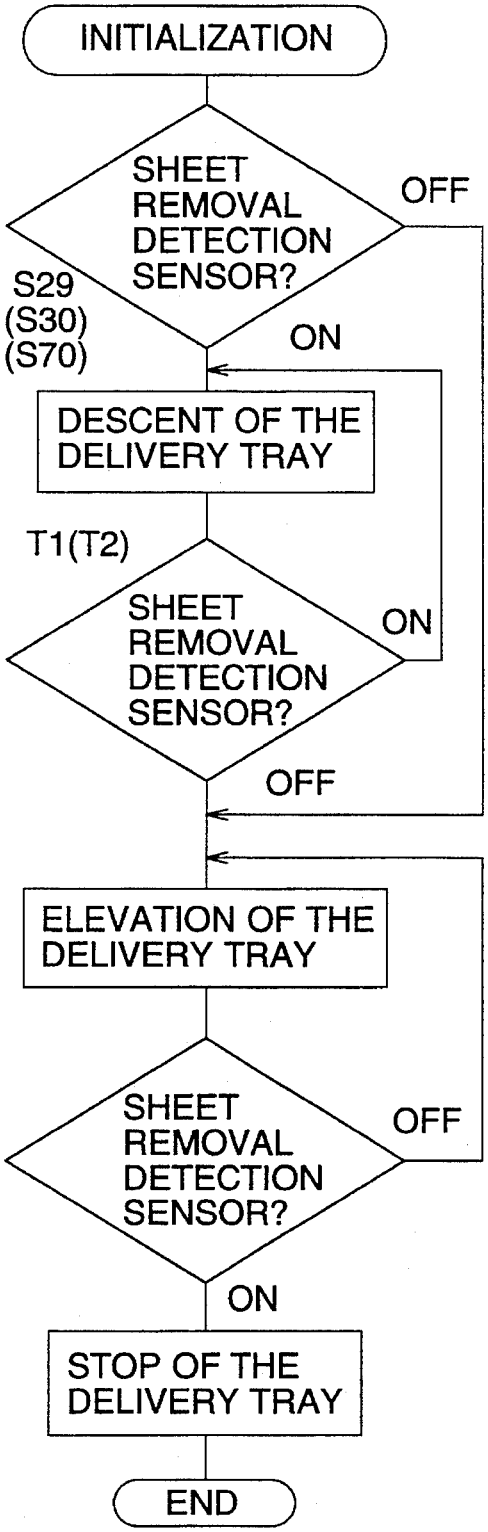
FIG. 16(*a*), FIG. 16(*b*) and FIG. 16(*c*) are flow charts showing the elevation control of the delivery tray.
Figure 16:
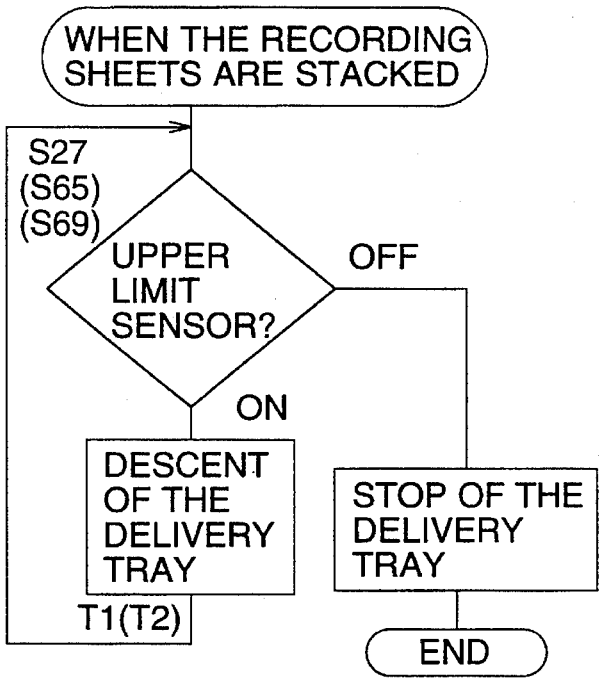
Figure 16:
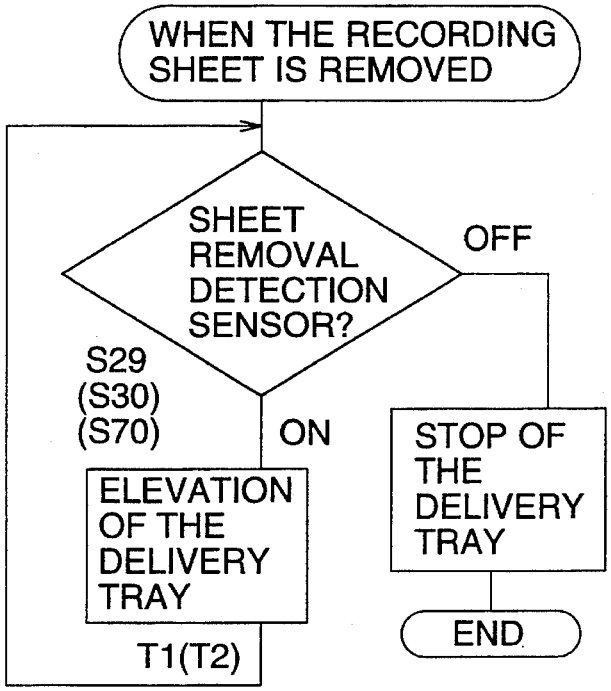
Figure 17:
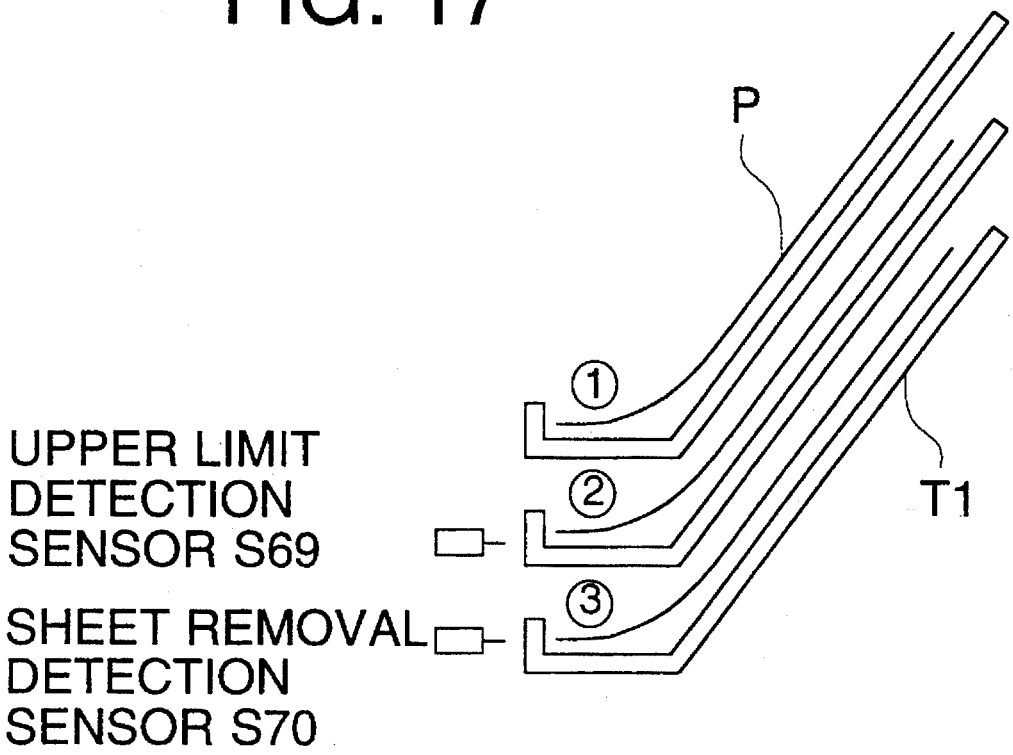
FIG. 17 is an illustration showing the elevation control of the delivery tray.
Figure 18:
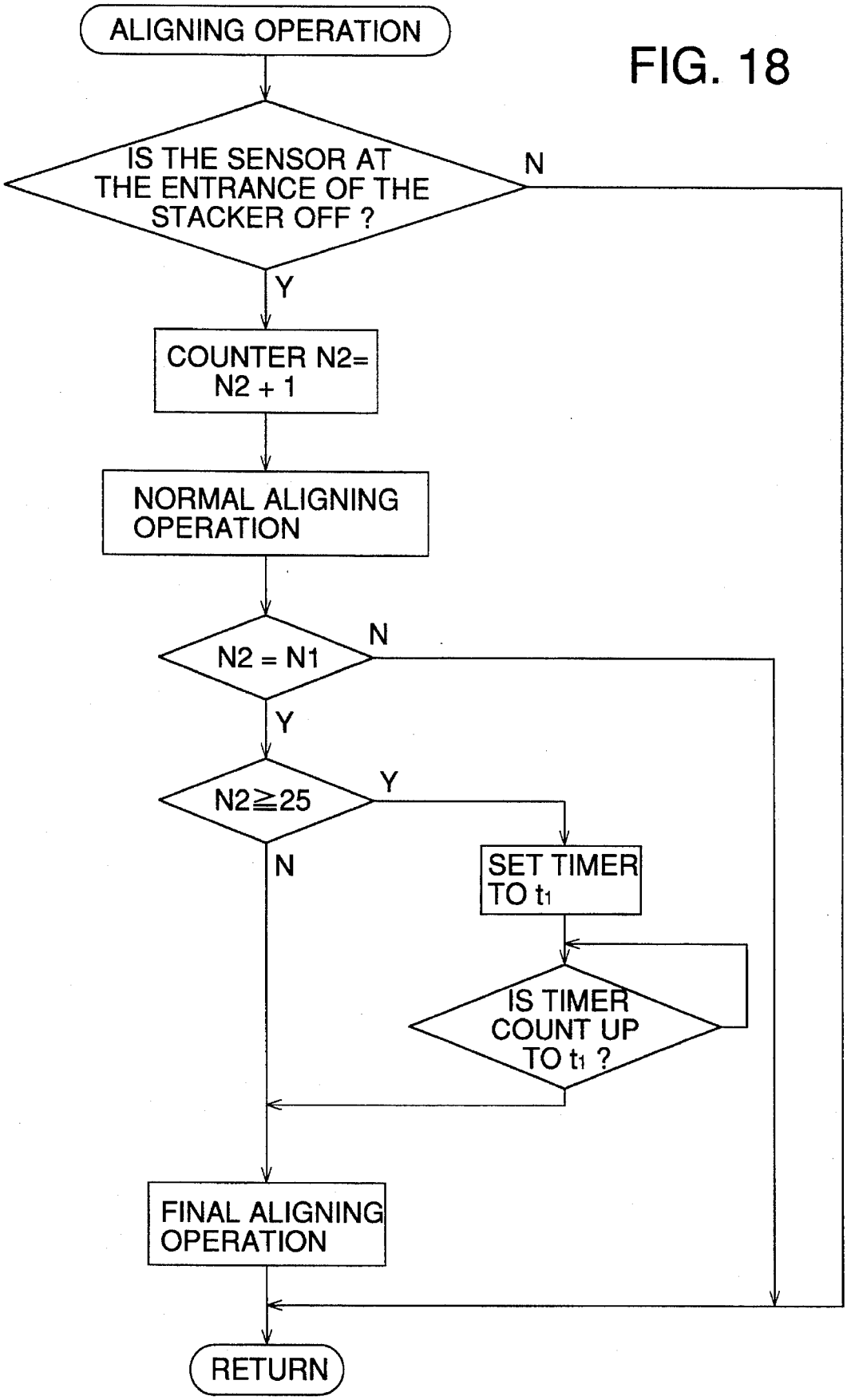

FIGS. 16(*a*), 16(*b*) and 16(*c*) are flow charts showing the elevation control operation of the delivery tray when the recording sheets are stacked on the tray, and when the recording sheets of the upper layer are removed while the recording sheets are being stacked on the tray, in the recording sheet finishing processing apparatus 400. FIG. 17 is an illustration showing the positions of the delivery trays T1, T2, the upper limit sensor S69, and the sheet removal detection sensor S70. In this connection, operations of the delivery tray for stapling and the delivery tray for offset processing are conducted in the same upper tray T1. Further, since three kinds of delivery operations, namely the offset sheet delivery, the stapler upper tray sheet delivery, and the stapler lower tray sheet delivery, are conducted by the same elevating operation, the example will be explained with respect to the offset delivery operation hereinafter.

Initially, the first sheet delivery tray T1 is structured in such a manner that the tray T1 is lowered being interlocked with stacking of the delivering sheets on the tray T1. The upper limit detection sensor S69 detects the upper limit of the sheets delivered onto the tray T1 (when no sheets exist on the tray T1, the upper limit of the first sheet delivery tray T1 is detected). When this upper tray detection sensor 69 detects no-sheet portion on the first sheet delivery tray T1, the output signal is turned off (LOW), and when the sensor 69 detects the sheet-stack portion, the output signal is turned on (HIGH). The sheet removal detection sensor S70 detects that some of the delivered sheets (or all of the delivered sheets) are removed by the operator during copying operation of the image forming apparatus, or after copying operation. That is, when the sheet removal detection sensor S70 detects no-sheet portion on the first sheet delivery tray T1, the output signal is turned off (LOW) in the same manner as the above-described upper limit detection sensor S69, and when the sensor S70 detects the sheet-stack portion, the output signal is turned on (HIGH).

Further, the vertical distance between the upper limit detection sensor S69 and the sheet removal detection sensor S70 is set to almost the same thickness as the number of sheets which can be stapled by one stapling operation by the stapler ST1.

This setting operation is carried out for the reason why the upper limit position of the sheets stacked on the first sheet delivery tray T1 is caused to always be located at a predetermined position even when the operator arbitrarily removes delivered sheets when the sheets are successively delivered from the image forming apparatus. In other words, the first sheet delivery tray T1 is operated so that the upper limit position of the stacked sheets is maintained at a predetermined position between the upper limit detection sensor S69 and the sheet removal detection sensor S70 in a real time response being accompanied with increase/decrease of the stacked amount of delivered sheets on the tray.

The operation of the first sheet delivery tray T1 includes the following three different operations: in a time series, (1) an initializing operation, (2) a sheet stacking operation, and (3) a positioning operation corresponding to the sheet removal operation by the operator. Specifically, these operations are as follows.

(1) Initializing operation

Before the image forming apparatus starts the copying operation, the position of the first sheet delivery tray T1 is initialized and the tray T1 is moved to a predetermined position. When sheets P on the first sheet delivery tray T1 are located at the positions ①, and ② as shown in FIG. 17, the first sheet delivery tray T1 is lowered until the sheet removal detection sensor S70 is turned off, and moved to the position ③ at which the position of the upper surface of the first sheet delivery tray T1, on which no sheets are stacked, is lower than that of the sheet removal detection sensor S70. When the first sheet delivery tray T1 is located at the position ③, and after the tray T1 has been lowered to the position ③, the first sheet delivery tray T1 is raised until the sheet removal detection sensor S70 is turned on, and moved to the position at which a portion of the first sheet delivery tray T1 is detected by the sheet removal detection sensor S70. Then, the first sheet delivery tray T1 is stopped at a predetermined position at which the upper surface of the first sheet delivery tray T1 is positioned between the upper limit detection sensor S69 and the sheet removal detection sensor S70 (refer to FIG. 16(*a*)).

(2) The sheet stacking operation

When sheets are stacked on the first sheet delivery tray T1 and the upper surface of the sheet is detected by the upper limit detection sensor S69, the upper limit detection sensor S69 is turned on. Accordingly, the first sheet delivery tray T1 is lowered until the upper limit sensor S69 is turned off, and the upper surface of the sheet is maintained at a predetermined position (refer to FIG. 16(*b*)).

(3) The positioning operation corresponding to the sheet removal operation

During the sheet stacking operation in the above described item (2), and when sheets on the first sheet delivery tray T1 are removed by the operator after the completion of the sheet stacking operation, sometimes the upper surface of sheets on the sheet delivery tray T1 (when sheets exist on the tray) or the upper surface of the tray (when all sheets are removed) is detected by the sheet removal detection sensor S70, and the sensor S70 is turned off. In this case, the first sheet removal tray T1 is elevated upward until the sheet removal detection sensor S70 is turned on, and stops (refer to FIG. 16(*c*)).

Since the removal detecting operation of the recording sheet stacked on the delivery tray and the initialized position detecting operation are carried out by the same sensor S29 (S30), it is advantageous to production cost reduction. Further, since high accuracy is required for the initial position detection means and the stacking amount detection means, it is very time-consuming to mount and adjust sensors. The time for the foregoing mounting operations can be greatly reduced by the present invention.

In the example, although the apparatus according to the present invention is connected to a copier, the apparatus can also be connected to an image forming apparatus such as printers, and facsimile machines.

According to the present invention, a recording sheet finishing processing apparatus can be provided in which a plurality of recording sheets can be very efficiently collated and stapled for each volume at high speed.

What is claimed is:

1. A recording sheet finishing apparatus in use with an image forming apparatus, comprising:

a stacker for stacking recording sheets conveyed in a conveyance direction from the image forming apparatus so as to form a bundle of said recording sheets on said stacker;

an aligning member for aligning said bundle of said recording sheets on said stacker by said aligning member moving in a direction perpendicular to said conveyance direction;

a stapler for stapling said bundle of said recording sheets which are aligned by said aligning member;

a counter for counting a number of said recording sheets bundled on said stacker, and for generating a counting signal; and a control for controlling said aligning member so that:

a) said aligning member aligns said bundle of said recording sheets a first predetermined time period after a last one of said recording sheets is aligned with other said recording sheets when said number of said recording sheets is less than a predetermined number; and b) said aligning member aligns said bundle of said recording sheets a second predetermined time period, which is longer than said first predetermined time period, after a last said recording sheet is aligned with said other recording sheets when said number of said recording sheets bundled on said stacker is not less than said predetermined number.

2. The apparatus of claim 1, wherein said predetermined number is 25.

3. The apparatus of claim 1, wherein said stacker is inclined vertically so that said stacker has a top portion and a bottom portion; and said recoding sheet finishing apparatus further comprises:

a stopper, provided in a vicinity of said bottom portion, for true up said recoding sheets.

* * * * *